US007363218B2

(12) United States Patent
Jabri et al.

(10) Patent No.: US 7,363,218 B2
(45) Date of Patent: Apr. 22, 2008

(54) METHOD AND APPARATUS FOR FAST CELP PARAMETER MAPPING

(75) Inventors: Marwan A. Jabri, Broadway (AU); Nicola Chong-White, Chatswood (AU); Jianwei Wang, Killarney Heights (AU)

(73) Assignee: Dilithium Networks Pty. Ltd., Sydney, NSW (AU)

( * ) Notice: Subject to any disclaimer, the term of this patent is extended or adjusted under 35 U.S.C. 154(b) by 886 days.

(21) Appl. No.: 10/693,620

(22) Filed: Oct. 23, 2003

(65) Prior Publication Data

US 2004/0172402 A1 Sep. 2, 2004

Related U.S. Application Data

(60) Provisional application No. 60/421,446, filed on Oct. 25, 2002, provisional application No. 60/421,449, filed on Oct. 25, 2002, provisional application No. 60/421,270, filed on Oct. 25, 2002.

(51) Int. Cl.
*G10L 19/10* (2006.01)

(52) U.S. Cl. ..... 704/221; 704/219

(58) Field of Classification Search ..... None
See application file for complete search history.

(56) References Cited

U.S. PATENT DOCUMENTS 5,457,685 A * 10/1995 Champion ..... 370/260
5,802,487 A 9/1998 Tanaka
5,995,923 A * 11/1999 Mermelstein et al. ..... 704/219
6,157,907 A 12/2000 Taori et al.
2003/0028386 A1* 2/2003 Zinser et al. ..... 704/500
2003/0065508 A1* 4/2003 Tsuchinaga et al. ..... 704/215
2004/0158647 A1 8/2004 Omura

FOREIGN PATENT DOCUMENTS

WO WO 99/66494 A1 12/1999
WO WO 02/080147 A 10/2002

OTHER PUBLICATIONS

Kim et al., "An Efficient Transcoding Algorithm for G. 723.1 and EVRC Speech Coders," Vehicular Technology Conference, 2001. VTC 2001 Fall. IEEE VTS 54th vol. 3, Issue , 2001 pp. 1561-1564.

* cited by examiner

*Primary Examiner*—Donald L. Storm
(74) *Attorney, Agent, or Firm*—Townsend and Townsend and Crew LLP

(57) ABSTRACT

An apparatus and method for mapping CELP parameters between a source codec and a destination codec. The apparatus includes an LSP mapping module, an adaptive codebook mapping module coupled to the LSP mapping module, and a fixed codebook mapping module coupled to the LSP mapping module and the adaptive codebook mapping module. The LSP mapping module includes an LP overflow module and an LSP parameter modification module. The adaptive codebook mapping module includes a first pitch gain codebook. The fixed codebook mapping module includes a first target processing module, a pulse search module, a fixed codebook gain estimation module, a pulse position searching module.

34 Claims, 16 Drawing Sheets

200

1600

METHOD AND APPARATUS FOR FAST CELP PARAMETER MAPPING

CROSS-REFERENCES TO RELATED APPLICATIONS

This application claims priority to U.S. Provisional Nos. 60/421,446 filed Oct. 25, 2002, 60/421,449 filed Oct. 25, 2002, and 60/421,270 filed Oct. 25, 2002, which are incorporated by reference herein.

STATEMENT AS TO RIGHTS TO INVENTIONS MADE UNDER FEDERALLY SPONSORED RESEARCH OR DEVELOPMENT

NOT APPLICABLE

BACKGROUND OF THE INVENTION

The present invention relates generally to telecommunication techniques. More particularly, the invention provides a method and apparatus for fast mapping of Code Excited Linear Prediction (CELP) model parameters. Merely by way of example, the invention has been applied to voice transcoding from one CELP coder/decoder (codec) to another CELP codec, but it would be recognized that the invention has a much broader range of applicability.

Code Excited Linear Prediction (CELP) speech coding techniques are widely used for speech codecs. Such codecs model voice signals as a source filter model. The source/excitation signal is generated via adaptive and fixed codebooks, and the filter is modeled by a short-term linear predictive coder (LPC). The encoded speech is then represented by a set of parameters which specify the filter coefficients and the type of excitation. Parameters of a CELP codec include the line spectral pair (LSP) parameters, adaptive codebook parameters, and fixed codebook parameters.

Industry standards codecs using CELP techniques include Global System for Mobile (GSM) Communications Enhanced Full Rate (EFR) codec, Adaptive Multi-Rate Narrowband (AMR-NB) codec, Adaptive Multi-Rate Wideband (AMR-WB), G.723.1, G.729, Enhanced Variable Rate Codec (EVRC), Selectable Mode Vocoder (SMV), QCELP, and MPEG-4. A transcoding process can convert CELP parameters from one voice compression format to another voice compression format. Some transcoding techniques fully decode the compressed signal back to a Pulse-Code Modulation (PCM) representation and then re-encode the signal. These techniques usually use a large amount of processing and incur significant delays. Other transcoding techniques convert CELP parameters from one compression format to the other while remaining in the parameter space. These techniques usually use complex computation that is prone to overflow errors.

Hence it is desirable to improve CELP transcoding techniques.

BRIEF SUMMARY OF THE INVENTION

The present invention relates generally to telecommunication techniques. More particularly, the invention provides a method and apparatus for fast mapping of Code Excited Linear Prediction (CELP) model parameters. Merely by way of example, the invention has been applied to voice transcoding from one CELP coder/decoder (codec) to another CELP codec, but it would be recognized that the invention has a much broader range of applicability.

According to an embodiment of the present invention, an apparatus for mapping CELP parameters in voice transcoders receives as input source codec CELP parameters and intermediate signals that have been interpolated to match the frame size, subframe size or other characteristic of the destination codec. The apparatus includes a LSP mapping module that maps interpolated LSP parameters to quantized LSP parameters, an adaptive codebook mapping module that maps the interpolated adaptive codebook parameters in a fast manner to produce quantized adaptive codebook parameters, and a fixed codebook mapping module that maps the interpolated fixed codebook parameters in a fast manner to produce quantized fixed codebook parameters. The LSP mapping module checks the interpolated LSP parameters for potential signal overflow when the transcoded signal is to be decoded by a device or system, adjusts the LSP parameters if signal overflow is predicted, and quantizes the LSP parameters. The adaptive codebook mapping module generates an adaptive codebook target signal, generates adaptive codebook candidate vector signals from the adaptive codebook for one or more candidate pitch lag values, computes a reduced set of auto-correlation and cross-correlation dot product terms of the adaptive codebook target signal and the candidate signals, and searches one or more entries of a simplified gain vector-quantized codebook for the entry that provides the maximum dot product with the vector of auto-correlation and cross-correlation dot product terms. The fixed-codebook mapping module generates a fixed codebook target signal, processes the fixed codebook target signal to create a modified target signal, performs a very fast pulse search to find initial pulse positions and signs which are used to estimate the fixed codebook gain, searches the algebraic codebook again using a fast pulse position searching technique, constructs the fixed codevector and outputs the fixed codebook indices.

According to another embodiment of the present invention, the method for mapping CELP parameters in voice transcoders includes mapping the interpolated LSP parameters into quantized LSP parameters of the destination codec, mapping the interpolated adaptive codebook parameters into quantized adaptive codebook parameters, and mapping the interpolated fixed codebook parameters into quantized fixed codebook parameters.

According to yet another embodiment of the present invention, the method for constructing a simplified pitch gain codebook for the adaptive codebook mapping. The method includes grouping gain product terms and reducing the size of the pitch gain codebook.

According to yet another embodiment of the present invention, a method for fast pulse position searching of the fixed algebraic codebook includes selecting the next track to search, locating positions for one or more pulses, subtracting the contribution of pulses in the current track from the target, and processing the target signal for the search for the remaining pulses.

According to yet another embodiment of the present invention, an apparatus for mapping CELP parameters between a source codec and a destination codec includes an LSP mapping module, an adaptive codebook mapping module coupled to the LSP mapping module, and a fixed codebook mapping module coupled to the LSP mapping module and the adaptive codebook mapping module. The LSP mapping module includes an LP overflow module configured to process information associated with a plurality of interpolated LSP parameters and generate an overflow signal based on at least information associated with the plurality of interpolated LSP parameters. Additionally, the LSP mapping module includes an LSP parameter modification module configured to modify at least one frequency of at least one of the plurality of interpolated LSP parameters in response to the overflow signal. The adaptive codebook mapping module includes a first pitch gain codebook. The first pitch gain codebook includes a first plurality of entries. Each of the first plurality of entries includes a plurality of terms and a plurality of sums associated with the plurality of terms. The fixed codebook mapping module includes a first target processing module configured to process a first target signal and generate a first modified target signal. Additionally, the fixed codebook mapping module includes a pulse search module configured to locate a first plurality of pulse positions and signs for a plurality of pulses in a subframe based on at least information associated with the first modified target signal. Moreover, the fixed codebook mapping module includes a fixed codebook gain estimation module configured to estimate a fixed codebook gain for the subframe based on at least information associated with the first plurality of pulse positions and signs. Also the fixed codebook mapping module includes a pulse position searching module configured to receive the first modified target signal, an impulse response signal and the estimated fixed codebook gain and to output a second plurality of pulse positions and signs for the plurality of pulses.

According to yet another embodiment of the present invention, an apparatus for mapping LSP parameters between a source codec and a destination codec includes an LP overflow module configured to process information associated with a plurality of interpolated LSP parameters and generate an overflow signal based on at least information associated with the plurality of interpolated LSP parameters. Additionally, the apparatus includes an LSP parameter modification module configured to modify at least one frequency of at least one of the plurality of interpolated LSP parameters in response to the overflow signal. Moreover, the apparatus includes a LSP quantization module configured to quantize the plurality of interpolated LSP parameters based on at least information associated with a plurality of quantization tables related to a destination codec. Also the apparatus includes an LSP decoder and stability check module configured to decode the quantized plurality of interpolated LSP parameters.

According to yet another embodiment of the present invention, an apparatus for mapping adaptive codebooks between a source codec and a destination codec includes an adaptive codebook target generation module configured to generate a target signal, and a pitch gain codebook. The pitch gain codebook includes a plurality of entries. Each of the plurality of entries includes a plurality of terms and a plurality of sums associated with the plurality of terms. Moreover, the apparatus includes a candidate lag selection module configured to receive an open-loop pitch lag and generate a candidate pitch lag value. Also the apparatus includes a candidate vector signal generation module configured to generate a plurality of candidate signals based on at least information associated with the adaptive codebook and the candidate pitch lag value. Additionally, the apparatus includes an auto-correlation and cross-correlation module configured to calculate a set of dot products of the target signal and delayed versions of the plurality of candidate signals or of the delayed versions of the plurality of candidate signals, and to output a vector signal associated with at least the set of dot products. Moreover, the apparatus includes a gain codevector selection module configured to receive the vector signal, to compute a dot product of an entry associated with the pitch gain codebook and the received vector signal, processing at least information associated with the dot product and a predetermined value, and output an index of a selected codevector and an adaptive codebook pitch lag associated with the selected codevector. Also the apparatus includes a buffer module to store the index of the selected codevector and the adaptive codebook pitch lag.

According to yet another embodiment of the present invention, an apparatus for mapping fixed codebooks between a source codec and a destination codec includes a fixed codebook target generation module configured to generate a target signal, and a target processing module configured to process the target signal and generate a first modified target signal. Additionally, the apparatus includes a pulse search module configured to locate a first plurality of pulse positions and signs for a plurality of pulses in a subframe based on at least information associated with the first modified target signal. Moreover, the apparatus includes a fixed codebook gain estimation module configured to estimate a fixed codebook gain for the subframe based on at least information associated with the first plurality of pulse positions and signs. Also the apparatus includes a pulse position searching module configured to receive the first modified target signal, an impulse response signal and the estimated fixed codebook gain and to output a second plurality of pulse positions and signs for the plurality of pulses. Additionally, the apparatus includes a codevector construction module configured to receive the second plurality of pulse positions and signs, to generate a fixed codebook vector, and to determine the fixed codebook indices for the subframe.

According to yet another embodiment of the present invention, a method for mapping CELP parameters between a source codec and a destination codec includes receiving a plurality of interpolated LSP parameters, a plurality of interpolated adaptive codebook parameters, and a plurality of interpolated fixed codebook parameters. Additionally, the method includes generating a plurality of quantized LSP parameters based on at least information associated with the plurality of interpolated LSP parameters, generating a plurality of quantized adaptive codebook parameters based on at least information associated with the plurality of interpolated adaptive codebook parameters, and generating a plurality of quantized fixed codebook parameters based on at least information associated with the plurality of interpolated fixed codebook parameters. The generating a plurality of quantized LSP parameters includes generating an overflow signal based on at least information associated with the plurality of interpolated LSP parameters. The generating a plurality of quantized adaptive codebook parameters includes estimating a dot product of an entry associated with a pitch gain codebook and a vector signal. The pitch gain codebook includes a plurality of entries. Each of the plurality of entries includes a plurality of terms and a plurality of sums associated with the plurality of terms. The generating a plurality of quantized fixed codebook parameters includes generating a first modified target signal based on at least information associated with a first target signal, locating a first plurality of pulse positions and signs for a plurality of pulses in a subframe based on at least information associated with the first modified target signal, estimating a fixed codebook gain for the subframe based on at least information associated with the first plurality of pulse positions and signs, and generating a second plurality of pulse positions and signs for the plurality of pulses based on at least information associated with the first modified target signal, an impulse response signal and the estimated fixed codebook gain.

Numerous benefits are achieved using the present invention over other techniques. Certain embodiments of the present invention provides an apparatus and method for fast LSP mapping, fast adaptive codebook mapping, and fast fixed codebook mapping. The apparatus and method can adjust mapped linear prediction parameters to prevent signal overflow in the decoder of a destination codec. Some embodiments of the present invention can reduce the amount of computation and the complexity of computational complexity. For example, computations for testing candidate codevectors is reduced, or computations for generating entries for the pitch gain codebook is reduced. In certain embodiments of the present invention, the amount of memory needed is also reduced. For example, the simplified pitch gain codebook contains fewer elements in each codevector entry. In some embodiments of the present invention, the auto-correlation and cross-correlation computation unit outputs a reduced length vector of dot-product elements in a format that matches the terms in the entries of the simplified pitch gain codebook. In certain embodiments, the complexity of the adaptive codebook search of the present invention is lower than the complexity of other adaptive codebook searches due to the simplification of the pitch gain codebook, the reduction in the number of computed correlation dot products, the reduction in the number of computed residual signals and the reduction in the number of computed delayed weighted synthesis signals.

Depending upon the embodiment under consideration, one or more of these benefits may be achieved. These benefits and various additional objects, features and advantages of the present invention can be fully appreciated with reference to the detailed description and accompanying drawings that follow.

DETAILED DESCRIPTION OF THE INVENTION

The present invention relates generally to telecommunication techniques. More particularly, the invention provides a method and apparatus for fast mapping of Code Excited Linear Prediction (CELP) model parameters. Merely by way of example, the invention has been applied to voice transcoding from one CELP coder/decoder (codec) to another CELP codec, but it would be recognized that the invention has a much broader range of applicability.

Figure 1:
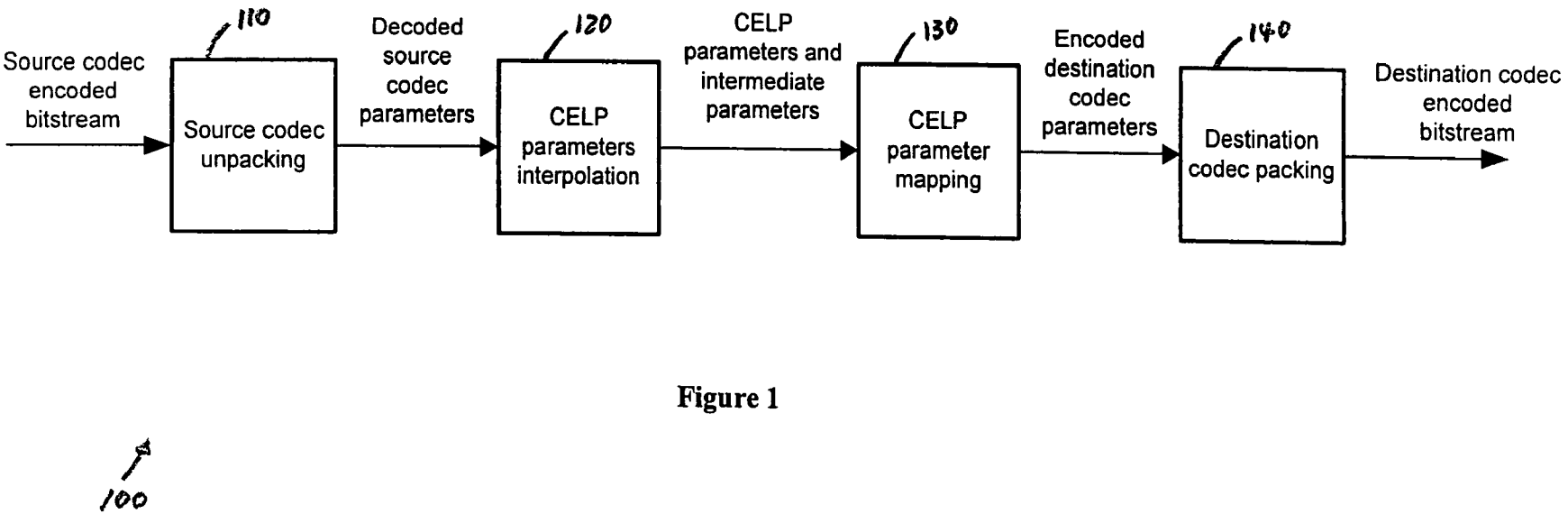
FIG. 1 is a simplified diagram for a transcoder between two CELP-based speech codecs.

FIG. 1 is a simplified diagram for a transcoder between two CELP-based speech codecs. See U.S. application Ser. No. 10/339,790 and Publication No. US 2003/0177004, which are incorporated by reference herein for all purposes. The transcoder includes source codec unpacking modules 110, CELP parameters interpolation modules 120, CELP parameter mapping modules 130, and destination codec packing modules 140. The CELP parameter interpolation modules 130 interpolate the CELP parameters to match the frame length and subframe length of the destination codec, and the resulting interpolated CELP parameters are mapped to form destination codec parameters by the CELP parameter mapping modules 130. The destination codec packing modules 140 pack the parameters to the bitstream in the required format.

Figure 2:
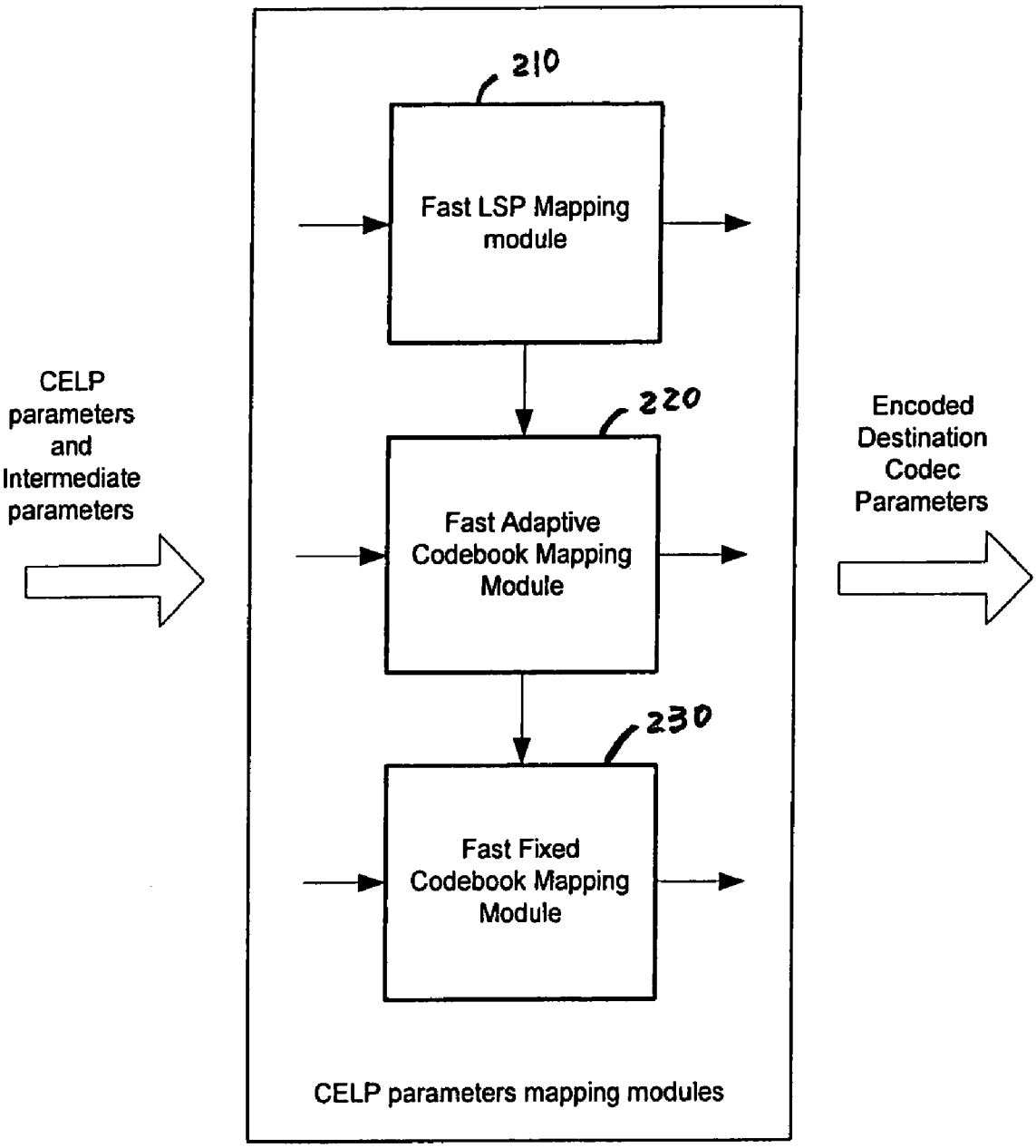
FIG. 2 is a simplified diagram for CELP parameter mapping modules according to one embodiment of the present invention.

FIG. 2 is a simplified diagram for CELP parameter mapping modules according to one embodiment of the present invention. This diagram is merely an example, which should not unduly limit the scope of the present invention. One of ordinary skill in the art would recognize many variations, alternatives, and modifications. A CELP parameter mapping modules 200 include a LSP mapping module 210, an adaptive codebook mapping module 220, and a fixed codebook mapping module 230. Although the above has been shown using various modules, there can be many alternatives, modifications, and variations. For example, some of the modules may be expanded and/or combined. Other modules may be inserted to those noted above. Depending upon the embodiment, the specific modules may be replaced. Further details of these modules are found throughout the present specification.

In one example, fast mapping techniques are applied to each of these modules in order to decrease the computational requirements for mapping, without degrading the signal quality. These techniques include fast processes for the adaptive codebook mapping and fixed codebook mapping.

Additionally, these techniques include a method to prevent signal overflow due to fast mapping of the LSP parameters from source-to-destination codec. These techniques can be used together, or in conjunction with other parameter mapping techniques. For example, the CELP parameter mapping modules 200 are used as the CELP parameter mapping modules 130.

In efficient transcoding from one linear prediction-based speech codec to another linear prediction-based speech codec, interpolation of the line spectral pair (LSP) parameters from source-to-destination codec is often used. This removes the need to recalculate the linear prediction (LP) parameters. Since different codecs may use a different frame length, subframe length, look-ahead delay, prediction order, bandwidth extension or type of LP analysis window, the LSP parameters from one codec may not be suited to another codec. In some cases, decoded LSP parameters from one codec that are interpolated and used to reconstruct speech in a second codec may cause quality degradation or even signal overflow due to unmatched LP analysis.

The LP coefficients are converted to LSP coefficients by searching along the unit circle and interpolating for zero crossings. LSPs can be converted to line spectral frequencies (LSFs) in Hz in the range $[0, f_s/2]$ by the following relation:

$$LSF_j = \frac{f_s}{2\pi}\arccos(LSP_j),\ j = 0,\ \ldots,\ N \qquad \text{(Equation 1)}$$

where $f_s$ is the sampling frequency and N is the prediction order. LSFs that are close to each other in frequency cause a sharp resonance in the LP filter which can lead to signal overflow. In many CELP-based speech codecs, a check is performed to test the LP filter stability. This makes sure that the LSFs are properly ordered and that there is a minimum distance, $\Delta_{min}$, between adjacent LSFs. A typical filter stability criterion is:

$$LSF_{j+1} - LSF_j \geq \Delta_{min},\ 1 \leq j \leq N-1, \qquad \text{(Equation 2)}$$

However, in transcoding from one codec to another, signal overflow can occur even if the stability criteria of both codecs are satisfied. This is apparent when fixed-point implementations of the speech decoders are applied.

For example, in a GSM-AMR to G.723.1 transcoder, the LSFs are linearly interpolated to compensate for the 20 ms frame size of GSM-AMR and 30 ms frame size of G.723.1. The interpolated LSFs are then quantized by G.723.1 and output to the bitstream. However, when the LSFs are decoded by a G.723.1 standard fixed-point implementation decoder, the unmatched LP analysis can cause the intermediate variables of the LSP-to-linear prediction coefficient (LPC) conversion in the G.723.1 decoder to overflow, even though the stability criteria of both GSM-AMR and G.723.1 are satisfied. Preventative measures need to be taken during transcoding to avoid signal overflow in the decoder.

Figure 3:
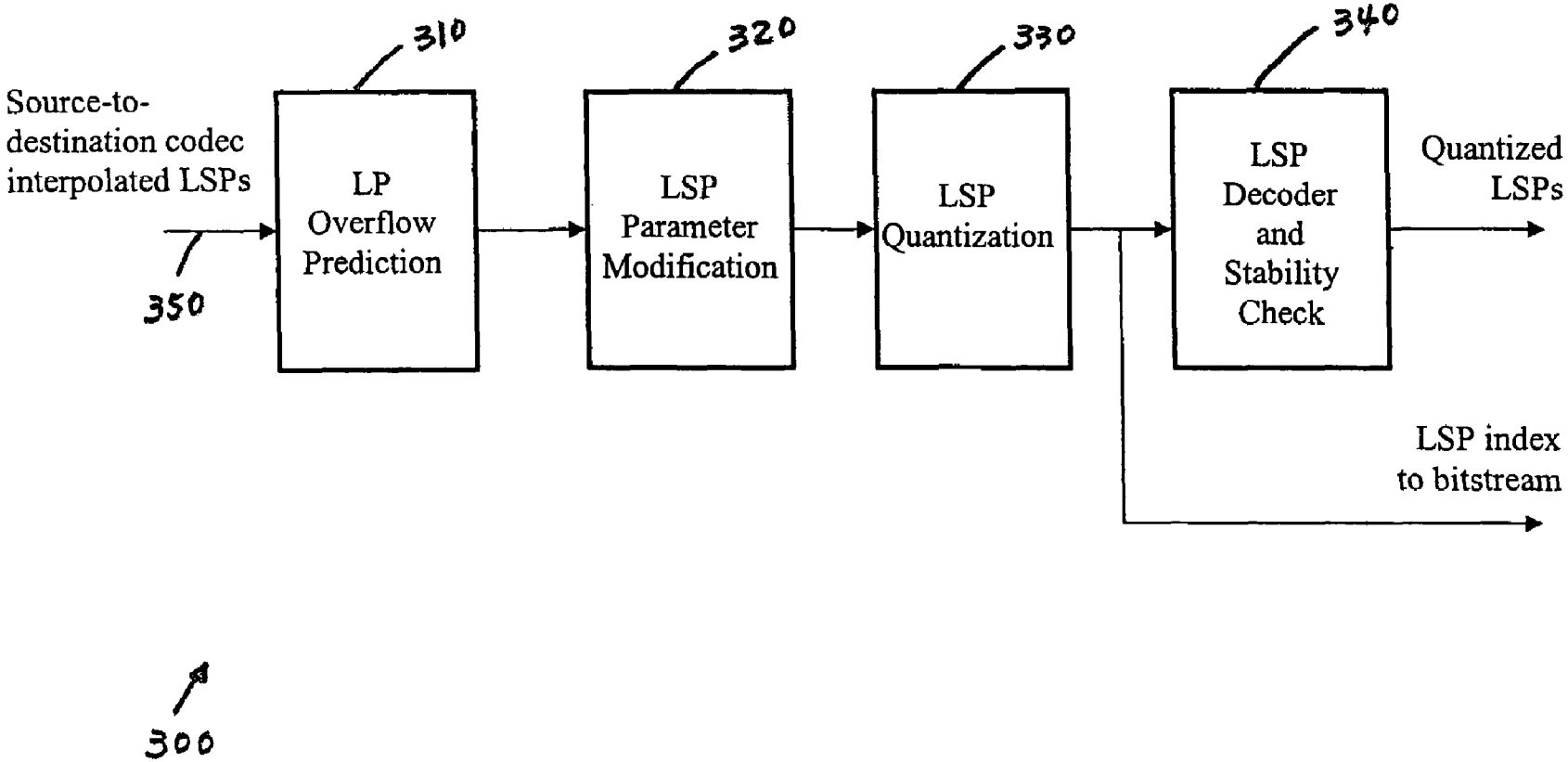
FIG. 3 is a simplified diagram for a fast LSP mapping module according to one embodiment of the present invention.

FIG. 3 is a simplified diagram for a fast LSP mapping module according to one embodiment of the present invention. This diagram is merely an example, which should not unduly limit the scope of the present invention. One of ordinary skill in the art would recognize many variations, alternatives, and modifications. A fast LSP mapping module 300 includes an LP overflow prediction module 310, an LSP parameter modification module 320, an LSP quantization module 330, and an LSP decoder and stability check module 340. Although the above has been shown using various modules, there can be many alternatives, modifications, and variations. For example, some of the modules may be expanded and/or combined. Other modules may be inserted to those noted above. Depending upon the embodiment, the specific modules may be replaced. Further details of these modules are found throughout the present specification.

The fast LSP mapping module 300 performs the conversion from source-to-destination codec interpolated LSP parameters to destination codec quantized LSP parameters. Additionally, the module 300 can detect potential decoder overflow situations and make LSF adjustment to avoid such signal overflow due to interpolated LSFs.

Figure 4:
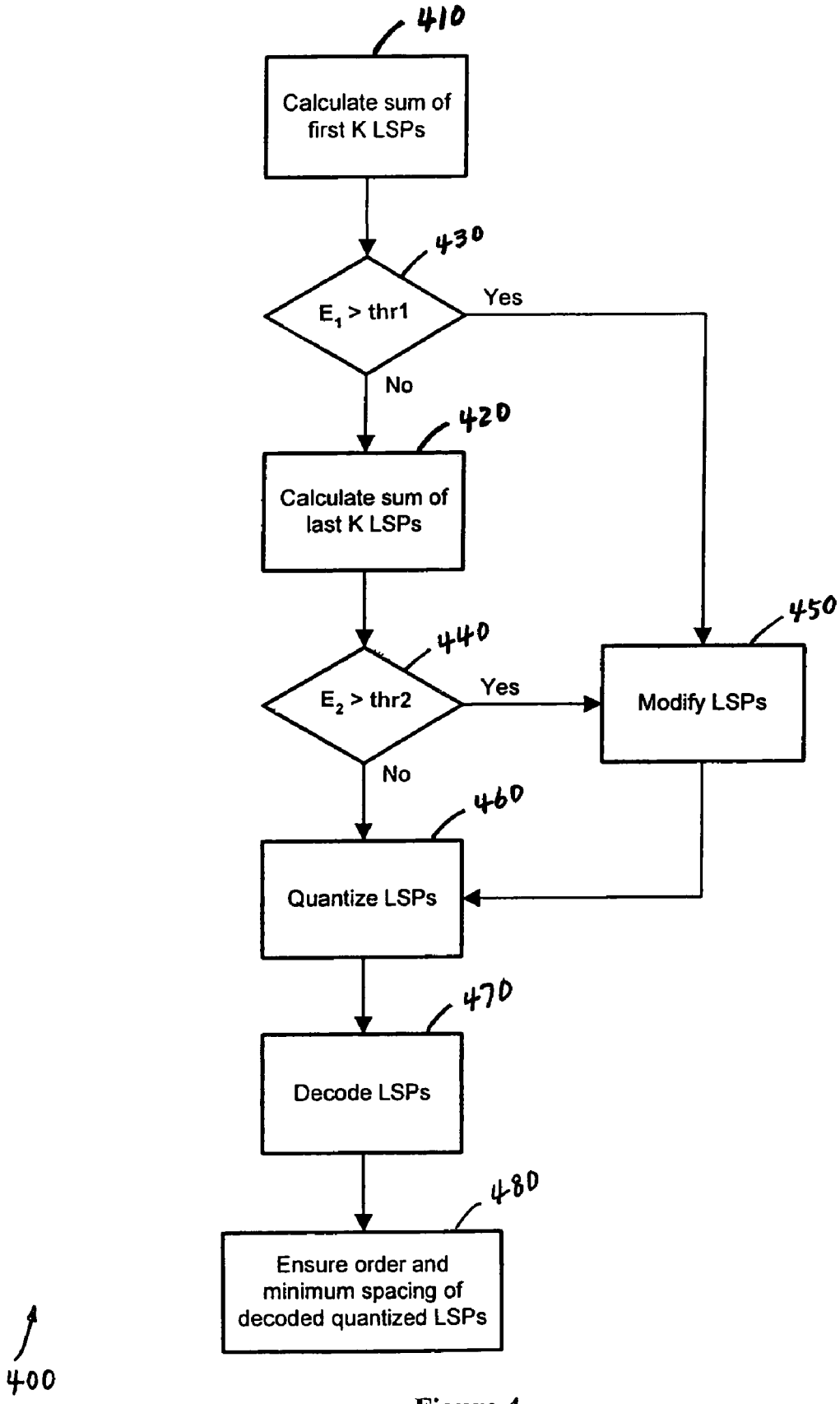
FIG. 4 is a simplified diagram for a method of fast LSP mapping according to one embodiment of the present invention.

FIG. 4 is a simplified diagram for a method of fast LSP mapping according to one embodiment of the present invention. This diagram is merely an example, which should not unduly limit the scope of the present invention. One of ordinary skill in the art would recognize many variations, alternatives, and modifications. As shown in FIG. 4, a method 400 of fast LSP mapping includes processes 410, 420, 430, 440, 450, 460, 470, and 480. Although the above has been shown using a selected sequence of processes, there can be many alternatives, modifications, and variations. For example, some of the processes may be expanded and/or combined. Other processes may be inserted to those noted above. Depending upon the embodiment, the specific sequence of steps may be interchanged with others replaced. The method 400 may be performed by the fast LSP mapping module 300. Additionally, the method 400 can adjust the frequencies of LSFs to avoid signal overflow without substantially affecting the speech quality. Further details of these processes are found throughout the present specification.

As shown in FIGS. 3 and 4, interpolated LSP parameters 350 are input to the LP overflow prediction module 310 which performs a check for potential LP overflow problems in the decoder. If signal overflow is predicted, the LSFs are modified in the LSP parameter modification module 320. The modification may be performed with various approaches. For example, at the processes 410 and 420, the LP overflow prediction module 310 takes as input the interpolated LSPs and computes the sum of the magnitudes of the first K LSPs, $E_1$, and the sum of the magnitudes of the last K LSPs, $E_2$ as follows:

$$E_1 = \sum_{i=1}^{K} |LSP(i)|, \qquad \text{(Equation 3)}$$

$$E_2 = \sum_{i=M-K-1}^{M-1} |LSP(i)|, \qquad \text{(Equation 4)}$$

where $K \leq \frac{M}{2}$ and $M$ is the order of prediction.

$K$ is a positive integer.

At the processes 430 and 440, $E_1$ is compared with Thr1 and $E_2$ is compared with Thr2 respectively. If $E_1$>Thr1 or $E_2$>Thr2, where Thr1 and Thr2 are predefined thresholds, signal overflow is predicted to occur in the decoder and the LSPs are then modified at the process 450 in the LSP parameter modification module 320. If $E_1$>Thr1, at least one frequency of at least one of the interpolated LSPs is increased. If $E_2$>Thr2, at least one frequency of at least one of the interpolated LSPs is decreased.

At the process 460, the LSP parameters are then quantized using the quantization tables and method of the destination codec by the LPS quantization module 330. At the processes 470 and 480, the quantized LSP parameters are decoded and a stability check is performed by the LSP decoder and stability check module 340. The stability check can usually ensure the correct ordering and minimum frequency spacing between adjacent LSPs. The decoded destination codec LSP parameters are used in further processing within a transcoder. For example, the fast LSP mapping module 300 is used as the fast LSP mapping module 210.

Figure 5:
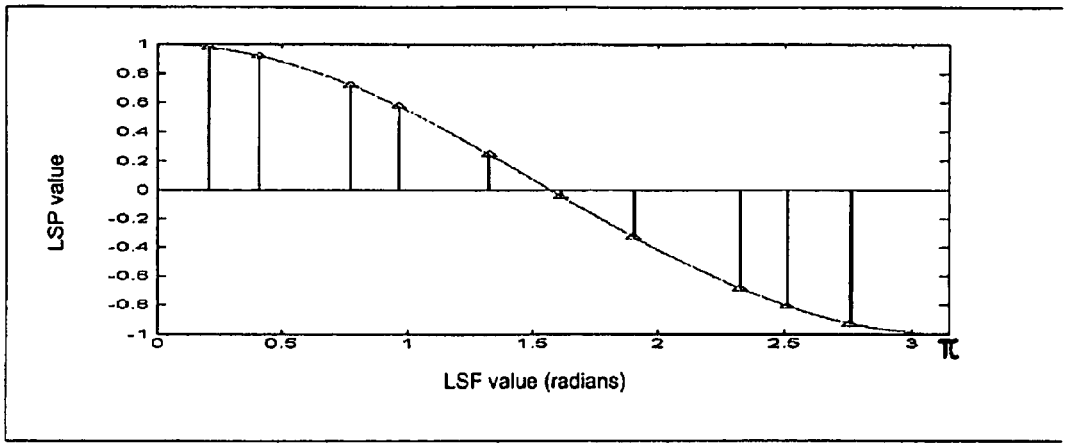
FIG. 5 is a simplified diagram for LSP parameters for a $10^{th}$ order stable LP analysis filter according to one embodiment of the present invention.

A $10^{th}$ order linear prediction filter is commonly used in speech codecs with a sampling frequency of 8 kHz. FIG. 5 is a simplified diagram for LSP parameters for a $10^{th}$ order stable LP analysis filter according to one embodiment of the present invention. This diagram is merely an example, which should not unduly limit the scope of the present invention. One of ordinary skill in the art would recognize many variations, alternatives, and modifications. The vertical component of each bar is the LSP value, which falls in the range $-1<LSP_i<+1$, and the horizontal component is the normalized LSF value, which falls in the range $0<LSF_i<\pi$.

Figure 6:
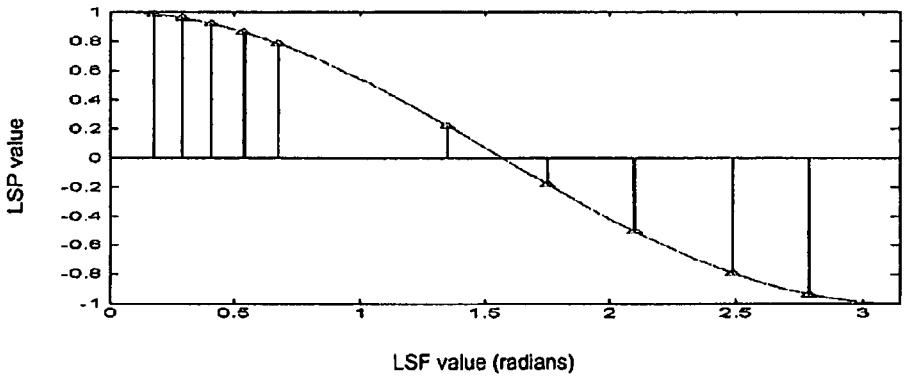
FIG. 6 is a simplified diagram for LSP parameters that may produce an unstable LP filter in the destination codec or signal overflow.

FIG. 6 is a simplified diagram for LSP parameters that may produce an unstable LP filter in the destination codec, or signal overflow. The first five LSP parameters have closely spaced LSF values and have LSP values close to one. Although these LSP parameters satisfy the minimum distance criterion between adjacent LSFs of 31.25 Hz, signal overflow is caused in the standard decoder. In comparison, according to an embodiment of the present invention, the LSP parameter modification avoids signal overflow due to interpolated LSPs from a codec with different LP analysis parameters, but also maintains the speech quality. As shown in FIG. 5, for a $10^{th}$ order prediction filter, modification of the first three LSP parameters is avoided as it affects the position of the perceptually important first format frequency, which degrades the signal quality. The modification thus increases the frequencies of the $4^{th}$, $5^{th}$ and $6^{th}$ LSFs by $f_4$ Hz, $f_5$ Hz, and $f_6$ Hz respectively when the average value of the first four LSPs exceeds 0.91. Different thresholds, frequency shifts and modifications to the LSFs can be applied to reduce the possibility of signal overflow in the decoder modules.

Certain embodiments of the present invention also provide a method and apparatus for performing a fast adaptive codebook mapping technique in voice transcoding. Multi-tap pitch prediction filters are used in some CELP-based speech coders such as ITU-T Recommendation G.723.1. The multi-tap pitch predictor achieves higher prediction gain than a single-tap predictor as its frequency response can interpolate between integer lags.

Figure 7:
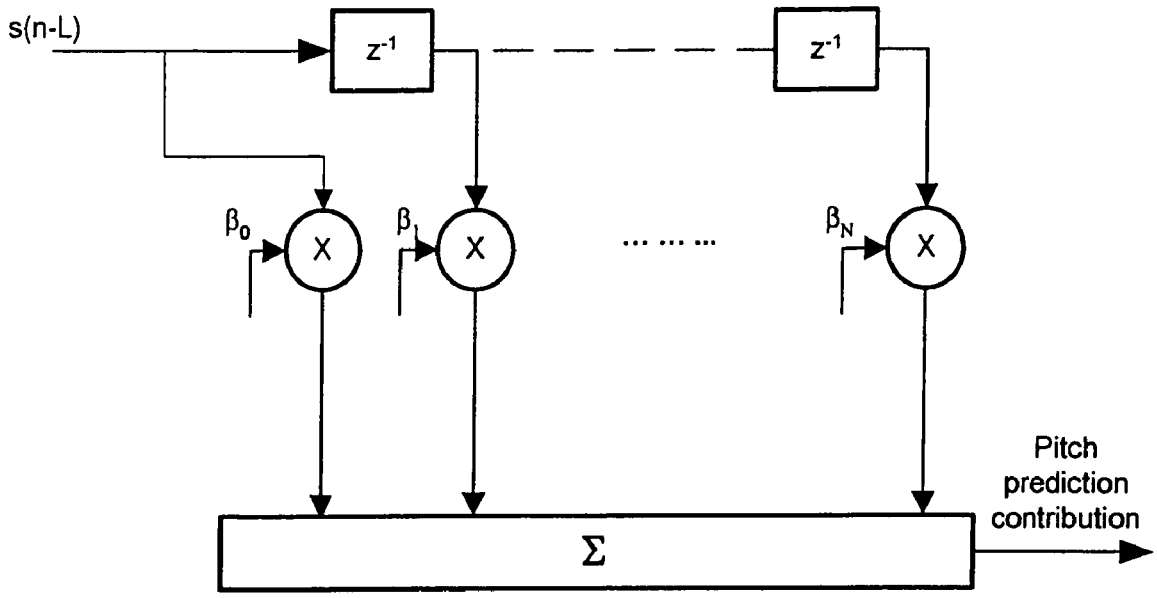
FIG. 7 is a simplified diagram for an N-tap pitch prediction filter.

FIG. 7 is a simplified diagram for an N-tap pitch prediction filter. The transfer function of a multi-tap filter is given by $$T(z) = \sum_{j=0}^{N-1} \beta_j z^{-(L+j)} \qquad \text{(Equation 5)}$$

where $\beta_j$ are the pitch predictor coefficients, N is the number of filter taps and L is the pitch lag. In CELP coding, a target signal, s(n), is generated, which may be in the speech domain, the excitation domain, or in the filtered excitation domain. In the excitation domain, the short-term linear-prediction contribution is removed. The error signal between the target signal, s(n), and the pitch prediction contribution for a subframe of length $l_{sf}$ is given by $$e(n) = s(n) - \sum_{j=-0}^{N-1} \beta_j s'\left(n - L - \frac{N}{2} + j\right), \quad n = 0, 1, \ldots, l_{sf}, \qquad \text{(Equation 6)}$$

where s'(n) may be a delayed version of the target signal, or obtained by filtering the adaptive codebook signal or past excitation signal by the weighted impulse response. The mean squared error, $\epsilon$, can be written as $$\varepsilon = e^T e = \sum_{n=0}^{l_{sf}} \left[ s(n) - \beta_0 s'\left(n - L - \frac{N}{2}\right) - \beta_1 s'\left(n - L - \frac{N}{2} + 1\right) - \ldots - \beta_{N-1} s'\left(n - L + \frac{N}{2}\right)\right]^2 \qquad \text{(Equation 7)}$$

To further expand the above equation, we can obtain:

$$\varepsilon = R_{ss}(0, 0) - \left[ \sum_{i=0}^{N-1} \beta_i R_{SS'}(0, i) - 2\sum_{i=0}^{N-1} \beta_i^2 R_{S'S'}(i, i) - 2\sum_{i=1}^{N-1} \sum_{j=0}^{i-1} \beta_i \beta_j R_{S'S'}(i, j) \right] \qquad \text{(Equation 8)}$$

where $R_{SS}(x, y)$, $R_{SS'}(x, y)$, $R_{S'S'}(x, y)$ are the auto-correlation and cross-correlation dot product terms as follows:

$$R_{SS}(0, 0) = \sum_{n=0}^{l_{sf}} s(n)^2, \qquad \text{(Equation 9)}$$

$$R_{SS'}(0, i) = \sum_{n=0}^{l_{sf-1}} s(n) s'\left(n - L - \frac{N}{2} + i\right), \qquad \text{(Equation 10)}$$

$$R_{S'S'}(i, j) = \sum_{n=0}^{l_{sf-1}} s'\left(n - L - \frac{N}{2} + i\right) s'\left(n - L - \frac{N}{2} + j\right). \qquad \text{(Equation 11)}$$

Figure 8:
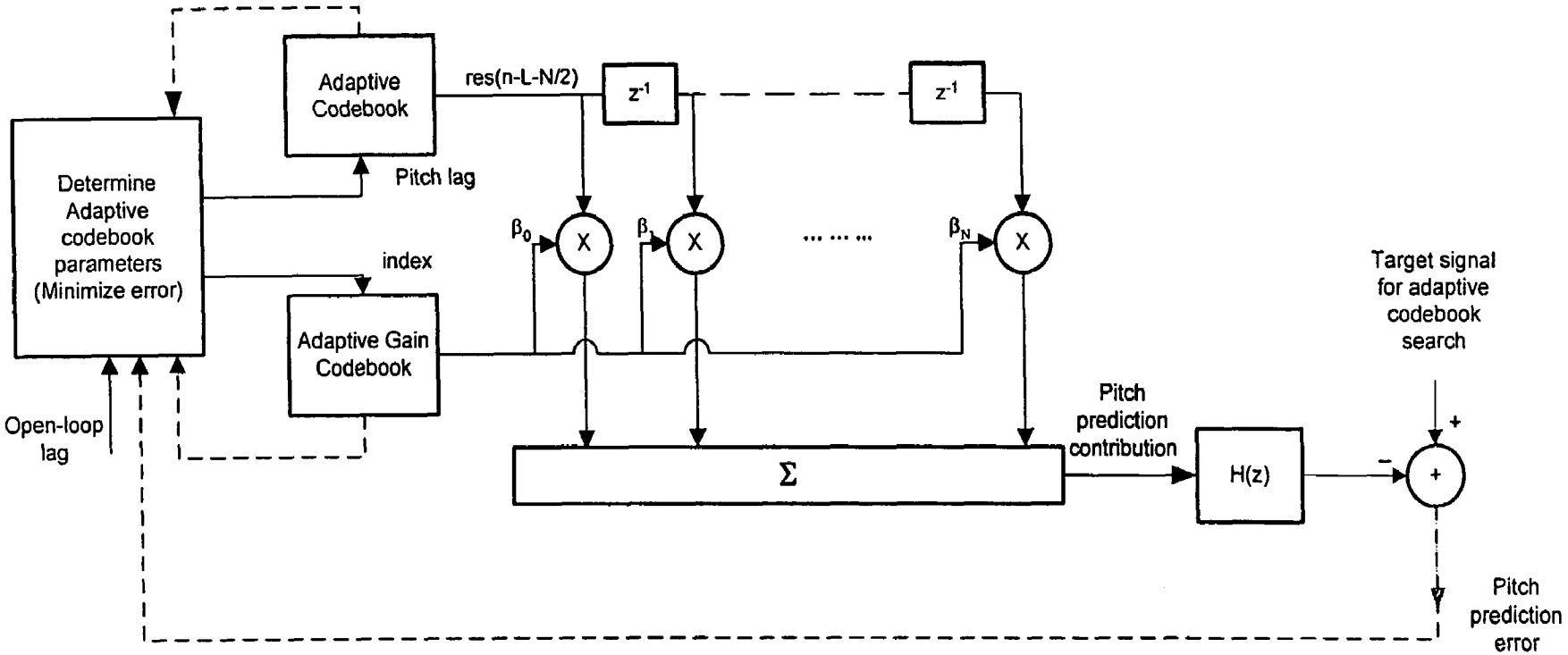
FIG. 8 is a simplified diagram illustrating the error minimization process to determine the adaptive codebook parameters in a CELP codec.

FIG. 8 is a simplified diagram illustrating the error minimization process to determine the adaptive codebook parameters in a CELP codec. To determine the optimum pitch parameters, the mean squared error is minimized. This involves finding the best gain coefficients $\beta=\{\beta_0, \beta_1, \ldots, \beta_{N-1}\}$ and the associated pitch lag L that produces the maximum value of the second term in Equation 8. While higher order pitch predictors achieve better performance, the number of $R_{S'S'}(i, j)$ terms required to be calculated increases exponentially. To ease the computational load, the gain product terms, $\beta_i\beta_j$, are often pre-calculated and stored in the gain codebook. For a 5-tap filter, 15 additional gain product terms are required. Each codebook vector thus contains 20 elements, which are the gain coefficients for each tap, and pre-computed products of the gain coefficients, as follows:

| | | | | | |
|---|---|---|---|---|---|
| 1st 5 elements: | $\beta_0$ | $\beta_1$ | $\beta_2$ | $\beta_3$ | $\beta_4$ |
| 2nd 5 elements: | $-\beta_0^2$ | $-\beta_1^2$ | $-\beta_2^2$ | $-\beta_3^2$ | $-\beta_4^2$ |
| Last 10 elements: | $-\beta_0\beta_1$ | $-\beta_0\beta_2$ | $-\beta_1\beta_2$ | $-\beta_0\beta_3$ | $-\beta_1\beta_3$ |
| | $-\beta_2\beta_3$ | $-\beta_0\beta_4$ | $-\beta_1\beta_4$ | $-\beta_2\beta_4$ | $-\beta_3\beta_4$ |

Figure 9:
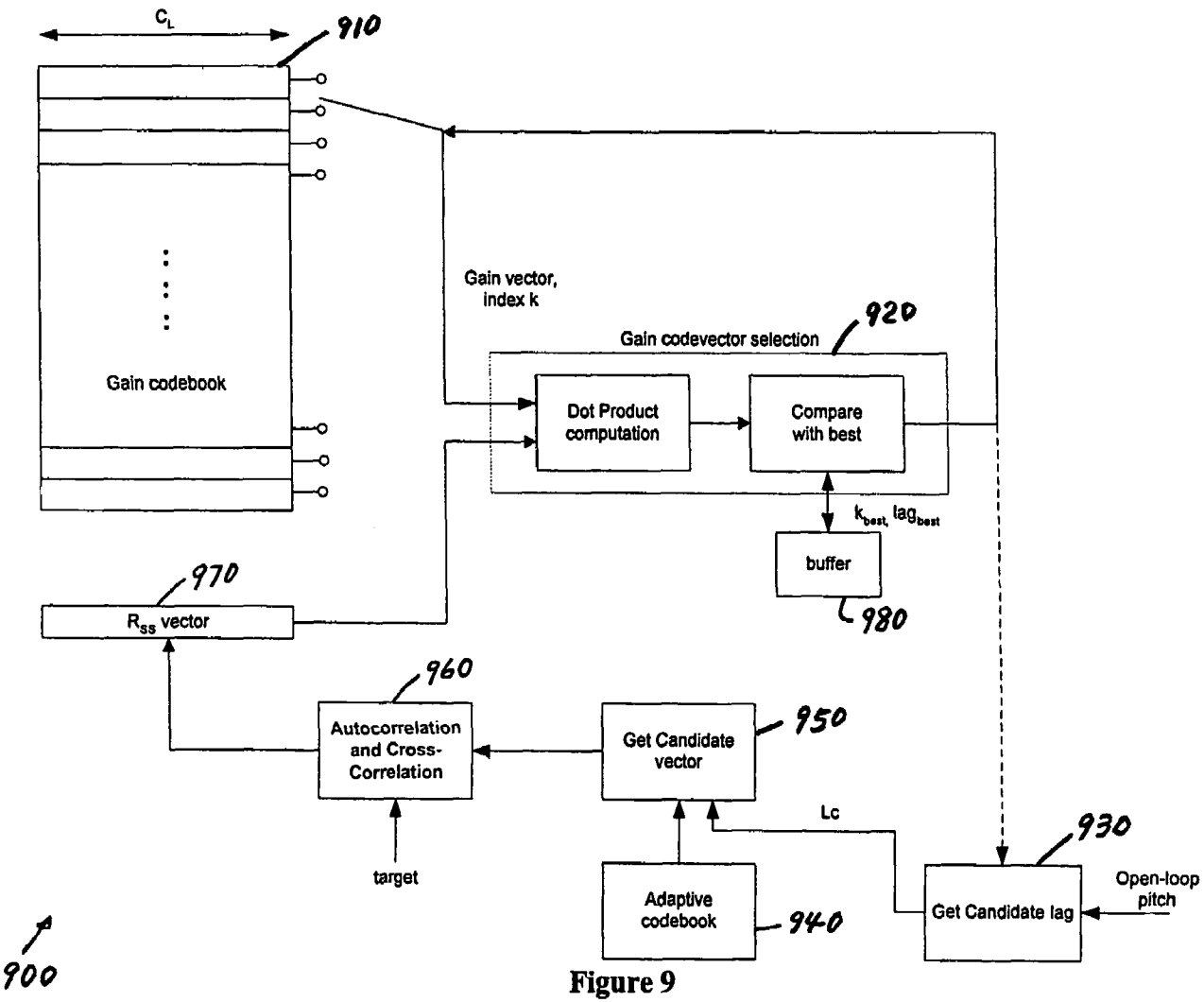
FIG. 9 is a simplified diagram for a procedure used to determine the pitch parameters in a CELP-based speech codec.

FIG. 9 is a simplified diagram for a procedure used to determine the pitch parameters in a CELP-based speech codec. The computed $R_{SS}$ vector contains $C_L$ auto-correlation and cross-correlation dot product terms for particular lag value. The dot product computation of the $R_{SS}$ vector and the gain vector with index k evaluates the second term of Equation 8. The computation is repeated for all codebook indices within a given range and all lag values within a given range, and the index, $k_{best}$, and lag value, $lag_{best}$, which produce the maximum dot product result, are stored.

As shown in FIG. 9, an adaptive codebook mapping module 900 includes a gain codebook 910, a gain codevector selection module 920, a get candidate lag module 930, an adaptive codebook 940, a get candidate vector module 950, an auto-correlation and cross-correlation module 960, and a buffer module 980. The auto-correlation and cross-correlation module 960 outputs an $R_{ss}$ vector 970.

In certain embodiments of the present invention, the complexity required to minimize the prediction error during encoding of the pitch parameters is reduced. The method is applied to speech coders that use a multi-tap pitch filter and a codebook of gain coefficients and pre-computed gain product terms. The method includes grouping similar $R_{S'S}(i, j)$ terms together. In a specific embodiment, auto-correlation dot product terms for common lag differences are grouped together. For example, if the pitch predictor has 5 taps, the $R_{S'S}(i, j)$ terms can be grouped as follows:

Group1: $R_{S'S}(0, 0)$, $R_{S'S}(1, 1)$, $R_{S'S}(2, 2)$, $R_{S'S}(3, 3)$, $R_{S'S}(4, 4)$, Group2: $R_{S'S}(0, 1)$, $R_{S'S}(1, 2)$, $R_{S'S}(2, 3)$, $R_{S'S}(3, 4)$ Group3: $R_{S'S}(0, 2)$, $R_{S'S}(1, 3)$, $R_{S'S}(2, 4)$ Group4: $R_{S'S}(0, 3)$, $R_{S'S}(1, 4)$ Group5: $R_{S'S}(0, 4)$ This arrangement groups autocorrelation dot-products of components with similar lag differences. In a further specific embodiment, the $R_{S'S}(i, j)$ terms within the same group can be assumed to be approximately equal. Therefore, instead of calculating 15 $R_{S'S}(i, j)$ terms, only 5 terms are required. Therefore, the $R_{SS}$ vector would contain only 10 terms.

Figure 10:
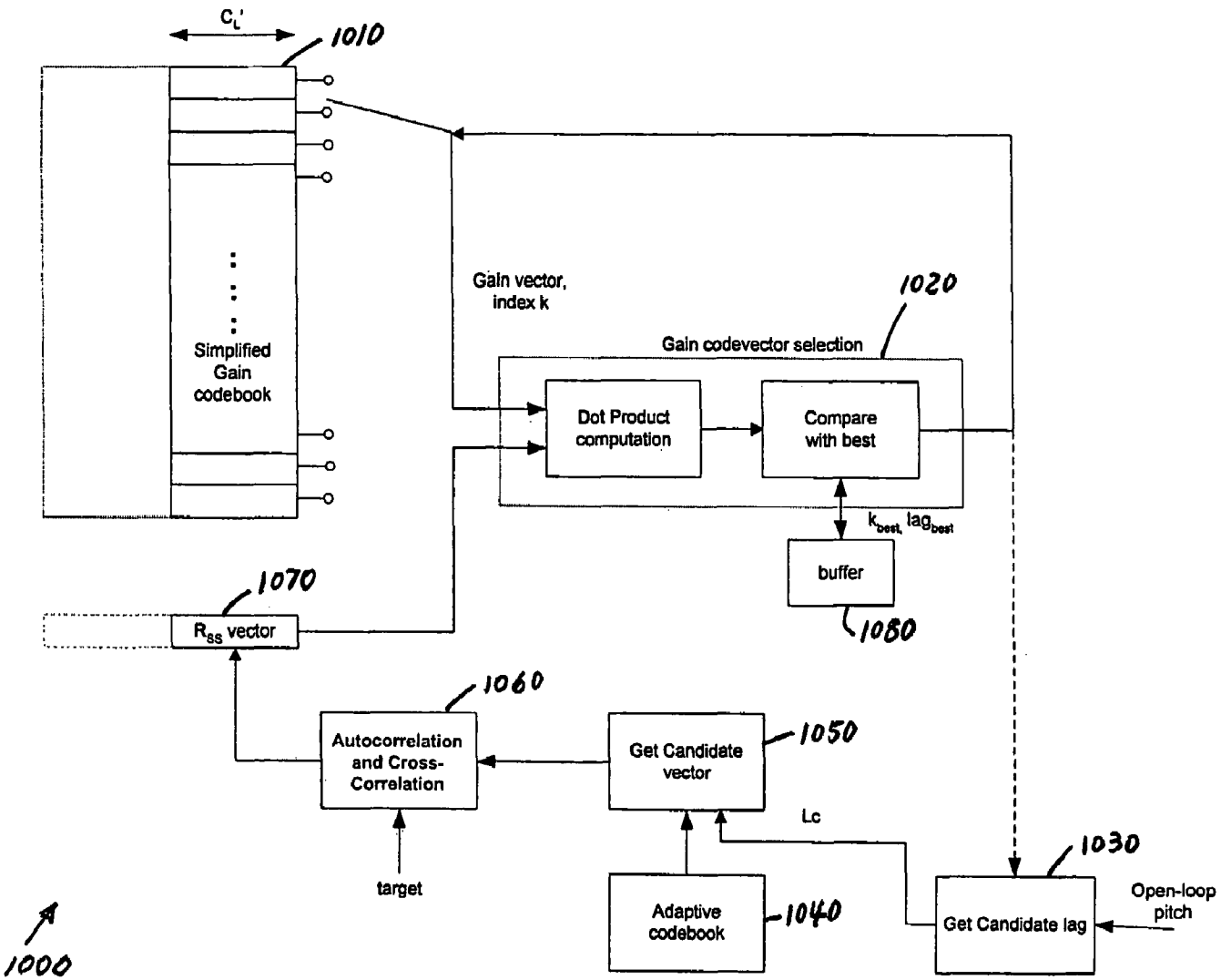
FIG. 10 is a simplified diagram for a fast adaptive codebook mapping module according to one embodiment of the present invention.

FIG. 10 is a simplified diagram for a fast adaptive codebook mapping module according to one embodiment of the present invention. This diagram is merely an example, which should not unduly limit the scope of the present invention. One of ordinary skill in the art would recognize many variations, alternatives, and modifications. A fast adaptive codebook mapping module 1000 includes a gain codebook 1010, a gain codevector selection module 1020, a get candidate lag module 1030, an adaptive codebook 1040, a get candidate vector module 1050, an auto-correlation and cross-correlation module 1060, and a buffer module 1080. Although the above has been shown using various modules, there can be many alternatives, modifications, and variations. For example, some of the modules may be expanded and/or combined. Other modules may be inserted to those noted above. Depending upon the embodiment, the specific modules may be replaced. Further details of these modules are found throughout the present specification.

As discussed above, the number of elements in each codevector of the simplified gain codebook 1010, $C_L'$ as shown in FIG. 10, is less than the number of elements in each codevector of the standard gain codebook 910, $C_L$ as shown in FIG. 9. In one example, the fast adaptive codebook mapping module 1000 is used as the fast adaptive codebook mapping module 220.

Figure 10A:
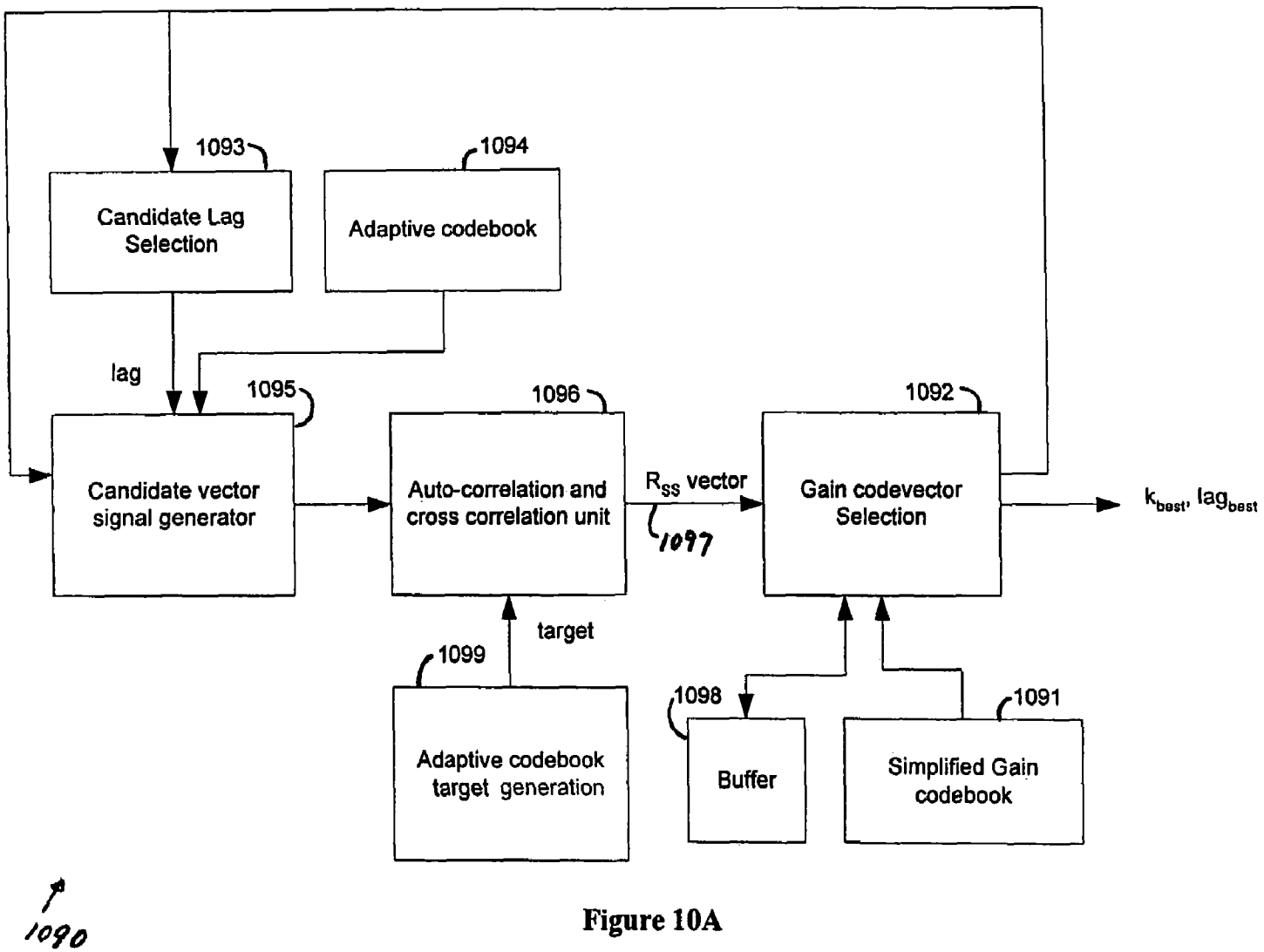
FIG. 10A is another simplified diagram for a fast adaptive codebook mapping module according to one embodiment of the present invention.

FIG. 10A is another simplified diagram for a fast adaptive codebook mapping module according to one embodiment of the present invention. This diagram is merely an example, which should not unduly limit the scope of the present invention. One of ordinary skill in the art would recognize many variations, alternatives, and modifications. A fast adaptive codebook mapping module 1090 includes a simplified gain codebook 1091, a gain codevector selection module 1092, a candidate lag selection module 1093, an adaptive codebook 1094, a candidate vector generation module 1095, an auto-correlation and cross-correlation module 1096, a buffer module 1098, and an adaptive codebook target generation module 1099. The fast adaptive codebook mapping module 1090 may be the same as or different from the fast adaptive codebook mapping module 1000. Although the above has been shown using various modules, there can be many alternatives, modifications, and variations. For example, some of the modules may be expanded and/or combined. Other modules may be inserted to those noted above. Depending upon the embodiment, the specific modules may be replaced. Further details of these modules are found throughout the present specification.

The adaptive codebook 1094 stores a plurality of excitation signals. The candidate lag selection module 1093 receives an open-loop pitch lag and generates a candidate pitch lag value. Based on at least information associated with the adaptive codebook 1094 and the candidate pitch lag value, the candidate vector signal generation module 1095 outputs a plurality of candidate signals. For example, the plurality of candidate signals are associated with a residual domain target signal and free from a synthesis. The adaptive codebook target generation module 1099 generates an adaptive codebook target signal. For example, the adaptive codebook target signal in a speech domain, a weighted speech domain, an excitation domain, or a filtered excitation domain. The auto-correlation and cross-correlation module 1096 performs a reduced set of dot products and produces a $R_{SS}$ vector 1097. In one example, the $R_{SS}$ vector 1097 is the same as the $R_{SS}$ vector 1070. The $R_{SS}$ vector 1097 is passed to the gain codevector selection module 1092, which searches at least one index of the gain codebook 1091 to find the index of the best gain codevector, $k_{best}$. The candidate pitch lag value that produced this $R_{SS}$ value is $lag_{best}$. $k_{best}$ and $lag_{best}$ are associated with an entry in the gain codebook 1091 and the candidate lag derived by the candidate lag selection 1093 that provides the maximum dot product with the vector of auto-correlation and cross-correlation dot product terms.

Figure 11:
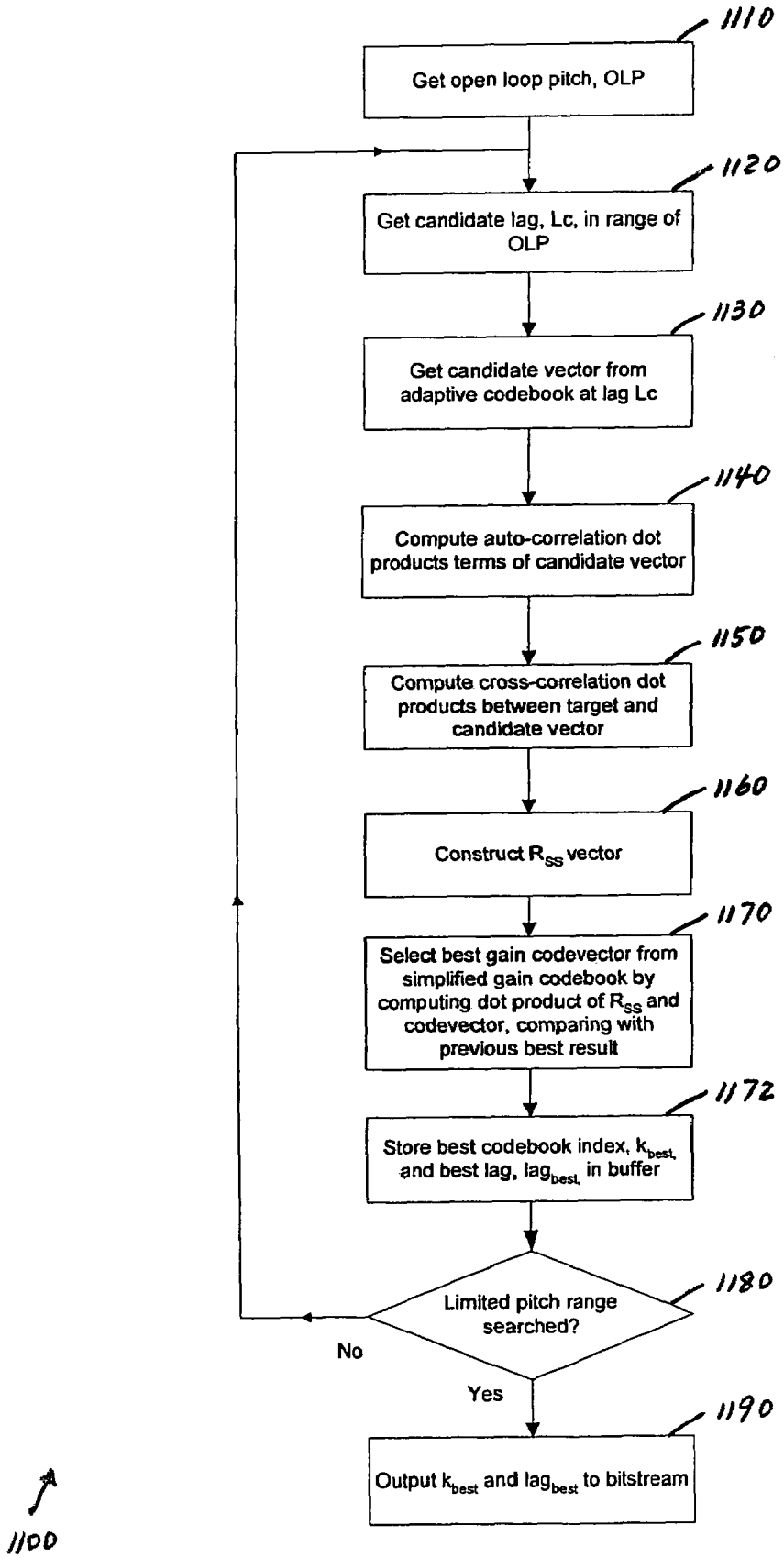
FIG. 11 is a simplified diagram for a method to determine the pitch parameters with the fast adaptive codebook search according to one embodiment of the present invention.

FIG. 11 is a simplified diagram for a method to determine the pitch parameters with the fast adaptive codebook search according to one embodiment of the present invention. This diagram is merely an example, which should not unduly limit the scope of the present invention. One of ordinary skill in the art would recognize many variations, alternatives, and modifications. A method 1100 to determine the pitch parameters includes a process 1110 for getting open loop pitch (OLP), a process 1120 for getting candidate lag $L_c$ in range of OLP, a process 1130 for getting candidate vectors from adaptive codebook at lag $L_c$, a process 1140 for computing auto-correlation dot products of candidate vector, a process 1150 for computing cross-correlation dot products between target and candidate vectors, a process 1160 for constructing an $R_{SS}$ vector, a process 1170 for selecting best gain codevector from simplified gain codebook, a process 1172 for storing best codebook index $k_{best}$ and best lag $lag_{best}$ in buffer, a process 1180 for determining whether a limited pitch range is search, and a process 1190 for outputting the best codebook index and best lag value bitstream. Although the above has been shown using a selected sequence of processes, there can be many alternatives, modifications, and variations. For example, some of the processes may be expanded and/or combined. Other processes may be inserted to those noted above. Depending upon the embodiment, the specific sequence of steps may be interchanged with others replaced. Further details of these processes are found throughout the present specification.

The storage requirements for the pitch gain codebook and the number of multiplications required to test each candidate codebook vector are reduced by $$\frac{C'_L}{C_L},$$

and the number of dot product terms and synthesized residual signals that need to be calculated are reduced by $$\frac{C'_L - \frac{N}{2}}{C_L - \frac{N}{2}}.$$

In one example, the method 1100 to determine the pitch parameters is implemented by the fast adaptive codebook mapping module 1000.

Figure 12:
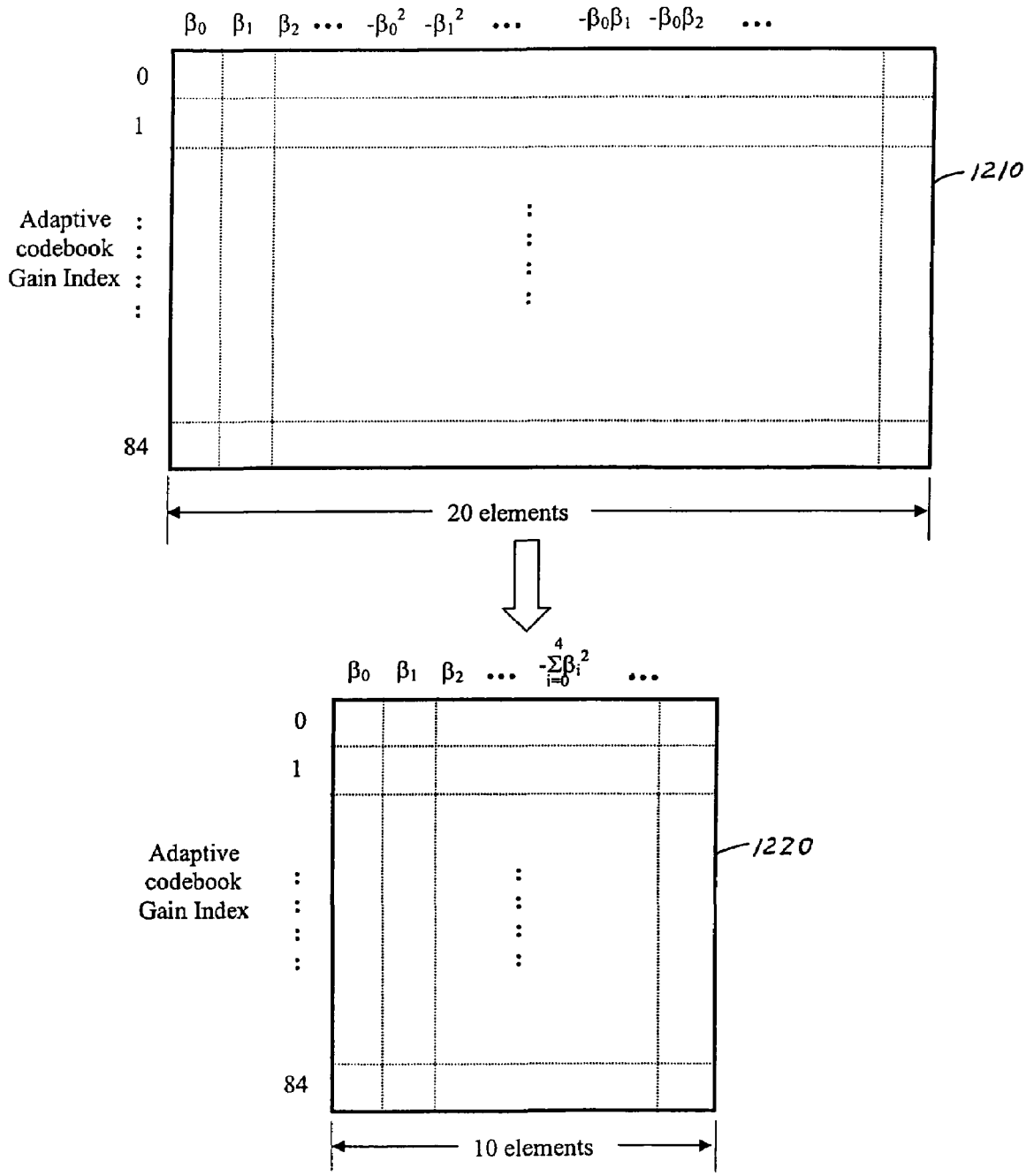
FIG. 12 is a simplified diagram comparing an adaptive codebook and another adaptive codebook according to one embodiment of the present invention.

FIG. 12 is a simplified diagram comparing an adaptive codebook and another adaptive codebook according to one embodiment of the present invention. This diagram is merely an example, which should not unduly limit the scope of the present invention. One of ordinary skill in the art would recognize many variations, alternatives, and modifications. As shown in FIG. 12, a pitch gain codebook 1210 can be used for a transcoder between the GSM Adaptive Multi-Rate (AMR) codec and the G.723.1 Dual Rate speech codec. G.723.1 uses a 5-tap pitch prediction filter. For subframe 0 and 2, the closed-loop pitch lag is selected from around the appropriate open loop pitch lag in the distance of ±1 samples. For subframes 1 and 3, the pitch lag may differ from the previous subframe lag only by −1, 0, +1 or +2 samples. The pitch predictor gains are vector quantized using either an 85-entry codebook or 170-entry codebook depending on the bit rate and lag value. Each codebook entry is a 20-element vector with pre-calculated gain coefficient terms and is arranged as follows:

| | | | | | |
|---|---|---|---|---|---|
| 1st 5 elements: | $\beta_0$ | $\beta_1$ | $\beta_2$ | $\beta_3$ | $\beta_4$ |
| 2nd 5 elements: | $-\beta_0^2$ | $-\beta_1^2$ | $-\beta_2^2$ | $-\beta_3^2$ | $-\beta_4^2$ |
| Last 10 elements: | $-\beta_0\beta_1$ | $-\beta_0\beta_2$ | $-\beta_1\beta_2$ | $-\beta_0\beta_3$ | $-\beta_1\beta_3$ |
| | $-\beta_2\beta_3$ | $-\beta_0\beta_4$ | $-\beta_1\beta_4$ | $-\beta_2\beta_4$ | $-\beta_3\beta_4$ |

According an embodiment of the present invention, the pitch gain codebook 1210 is reconstructed so that each entry has only 10 elements, as depicted for an 85-entry pitch gain codebook 1220 in FIG. 12. This reconstruction can also be performed for an 170-entry pitch gain codebook. For example, the plurality of entries in the pitch gain codebook 1210 are correlated to another plurality of entries of another pitch gain codebook of a destination codec.

For each entry of the pitch gain codebook 1210, the last 5 elements are calculated by summing the appropriate terms of the pitch gain codebook 1210. The resulting simplified pitch gain codebook 1220 has the following format:

| | | | | | |
|---|---|---|---|---|---|
| 1st 5 elements: | $\beta_0$ | $\beta_1$ | $\beta_2$ | $\beta_3$ | $\beta_4$ |
| 2nd 5 elements: | $\sum_{i=0}^{4}\beta_i^2$ | $\sum_{i=0}^{3}\beta_i\beta_{i+1}$ | $\sum_{i=0}^{2}\beta_i\beta_{i+2}$ | $\sum_{i=0}^{1}\beta_i\beta_{i+3}$ | $\beta_0\beta_4$ |

This approximation and simplification halves the memory storage requirements for the pitch gain codebook, halves the number of multiplications and additions required to test each codebook candidate and reduces the number of $R_{S'S}(i, j)$ dot-product terms and synthesized residual signals that need to be calculated by a factor of 3.

The following equation is maximized during the fast adaptive codebook search $$\max\left[\sum_{j=0}^{P-1} C_i \cdot R_{SS'}(0, i) - C_5 \cdot R_{S'S'}(2, 2) - 2C_6 \cdot R_{S'S'}(0, 1) - 2C_7 \cdot R_{S'S'}(0, 2) - 2C_8 \cdot R_{S'S'}(0, 3) - 2C_9 R_{S'S'}(0, 4)\right] \quad \text{(Equation 12)}$$

where $C_i$ are the $i^{th}$ elements of an entry in the simplified gain codebook. The $R_{S'S}(i, j)$ terms are chosen to be representative of their respective group, and may be substituted with another auto-correlation dot product term of the same group.

Certain embodiments of the present invention also provide a method and apparatus for a fast fixed codebook mapping technique in voice transcoders. Some CELP speech coding algorithms use algebraic-structured fixed codebooks to reduce the amount of storage memory required. Algebraic codevectors are sparse and have pulses with amplitudes of ±1 at certain positions. The number of pulses and candidate pulse locations for the codevector varies between coding algorithms.

For example, potential pulse positions for each pulse in the subframe are shown in Tables 1 and 2 for GSM-AMR 12.2 kbps and 10.2 kbps modes respectively.

TABLE 1

| Track | Pulse | Positions |
|---|---|---|
| 0 | i0, i5 | 0, 5, 10, 15, 20, 25, 30, 35 |
| 1 | i1, i6 | 1, 6, 11, 16, 21, 26, 31, 36 |
| 2 | i2, i7 | 2, 7, 12, 17, 22, 27, 32, 37 |
| 3 | i3, i8 | 3, 8, 13, 18, 23, 28, 33, 38 |
| 4 | i4, i9 | 4, 9, 14, 19, 24, 29, 34, 39 |

TABLE 2

| Track | Pulse | Positions |
|---|---|---|
| 0 | i0, i4 | 0, 4, 8, 12, 16, 20, 24, 28, 32, 36 |
| 1 | i1, i5 | 1, 5, 9, 13, 17, 21, 25, 29, 33, 37 |
| 2 | i2, i6 | 2, 6, 10, 14, 18, 22, 26, 30, 34, 38 |
| 3 | i3, i7 | 3, 7, 11, 15, 19, 23, 27, 31, 35, 39 |

In these cases, the tracks are interleaved, and do not share common pulse positions. As shown in Table 1, for the 12.2 kbps mode, there are 5 tracks within the 40 sample subframe, with 8 possible pulse positions in each track. The codevector has 10 pulses, with 2 pulses located in each track. As shown in Table 2, for the 10.2 kbps mode, there are 4 tracks within the 40 sample subframe, with 2 pulses allowed per track.

Figure 13:
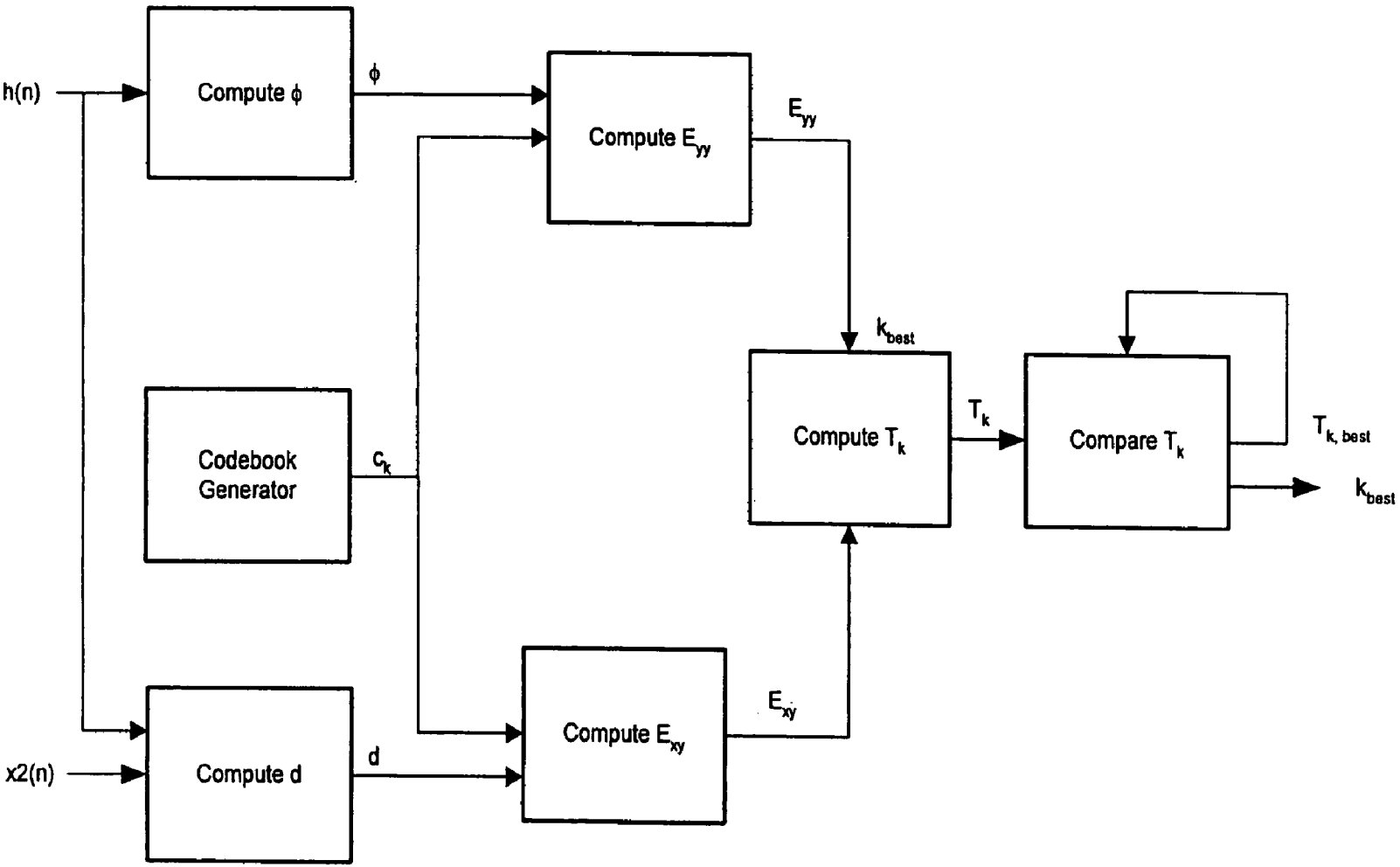
FIG. 13 is a simplified block diagram of an apparatus used to perform the algebraic codebook search in CELP codecs.

FIG. 13 is a simplified block diagram of an apparatus used to perform the algebraic codebook search in CELP codecs. For example, the apparatus is used to find the codevector $c_k$ in the fixed codebook that best matches the target signal. The target signal, $X_2(n)$ is generated by subtracting the adaptive codebook contribution from the weighted input speech signal. The algebraic codebook is searched by maximizing the term $$T_k = \frac{E_{xy}}{E_{yy}} = \frac{(d^t c_k)^2}{c_k \Phi c_k}, \quad \text{(Equation 13)}$$

where $d=H^t x_2$ is the correlation between the target signal and the impulse response of the weighted synthesis filter, h(n), $H=h^T h$ is the lower triangular Toeplitz matrix with diagonal h(0) and lower diagonals h(1), . . . , h(39), $c_k$ is the codevector with index k, and $\Phi=H^T H$ is the autocorrelation matrix of h(n). The computational load is often measured by the number of $T_k$ computations, or candidates tested. The full ACELP search is highly computationally demanding and the complexity of the search can be reduced by testing a smaller number of codebook candidates. The different algebraic structures and number of pulses per codevector differs between standards, as well as the search method applied in each standard to reduce the complexity. For example, G.729 uses a focused search and 1440 candidates are tested out of a possible 8192 candidates. GSM-AMR uses a depth-first tree search after fixing the first pulse at the local maximum, and the number of candidates tested for the highest mode is 1024. Even with these fast approaches, the computational complexity is still large and up to 40% of the total computational complexity of the transcoder.

Figure 14:
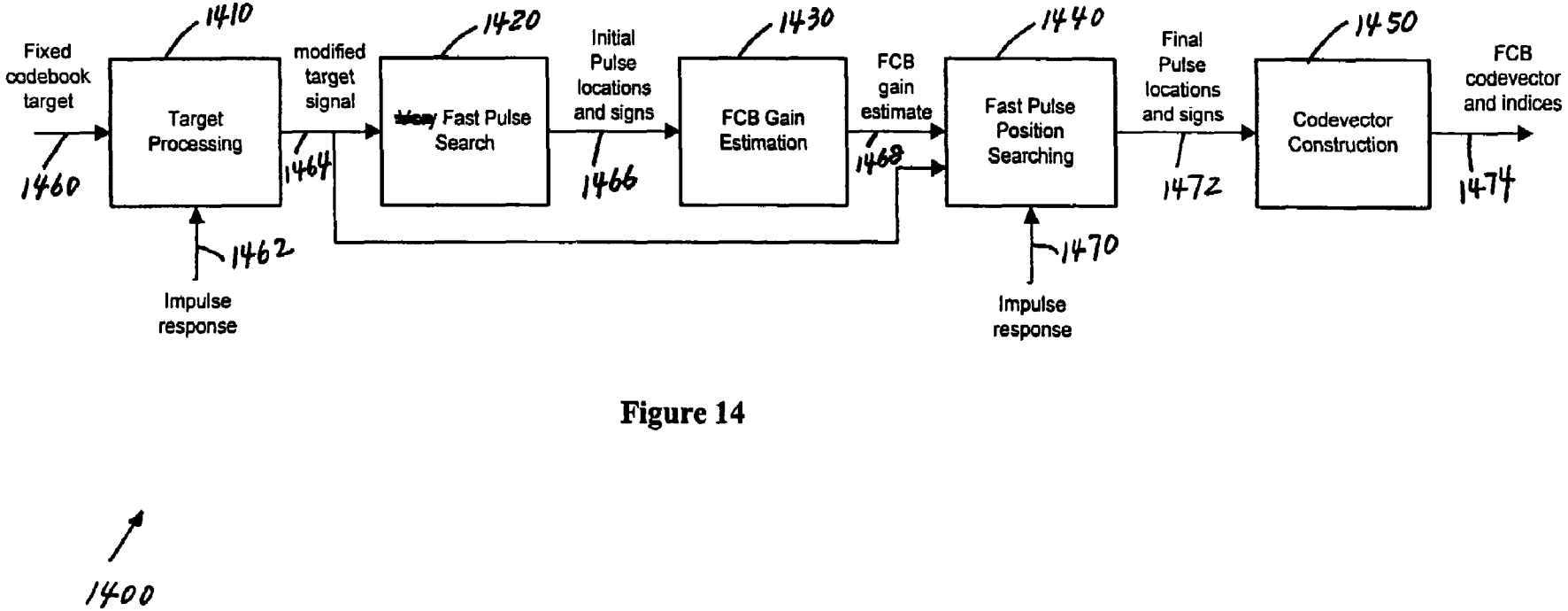
FIG. 14 is a simplified diagram for a fast fixed codebook mapping module according to one embodiment of the present invention.

FIG. 14 is a simplified diagram for a fast fixed codebook mapping module according to one embodiment of the present invention. This diagram is merely an example, which should not unduly limit the scope of the present invention. One of ordinary skill in the art would recognize many variations, alternatives, and modifications. A fast fixed codebook mapping module 1400 includes a target processing module 1410, a fast pulse search module 1420, a fixed codebook (FCB) gain estimation module 1430, a fast pulse position searching module 1440, and a codevector construction module 1450. Although the above has been shown using various modules, there can be many alternatives, modifications, and variations. For example, some of the modules may be expanded and/or combined. Other modules may be inserted to those noted above. Depending upon the embodiment, the specific modules may be replaced. Further details of these modules are found throughout the present specification.

In one example, the module 1400 performs fast fixed codebook mapping on each subframe of the target signal. In another example, the fast fixed codebook mapping module 1400 is used as the fast fixed codebook mapping module 230. For example, the fixed codebook mapping module 1400 is associated with a fixed codebook, the fixed codebook being an algebraic fixed codebook or a multi-pulse fixed codebook. In another example, the fixed codebook mapping module 1400 is associated with a destination codec including a sparse fixed codebook.

A fixed codebook target signal 1460, $x_2(n)$, may be generated by a fixed codebook target generation module. For example, the target signal 1460 is in a speech domain, a weighted speech domain, an excitation domain, or a filtered excitation domain. The signal 1460 is correlated with an impulse response signal 1462, h(n), of the LP filter to form a modified target signal 1464, A(n), in the target processing module 1410 as follows:

$$A(n)=\Sigma x_2(j)\cdot h(j+n),\ n=0, \ldots, l_{sf} \quad \text{(Equation 14)}$$

The fast pulse search module 1420 then takes the modified target signal 1464, A(n), and sets the locations for all $N_p$ pulses required in the codevector at the $P_t$ highest positions of the relevant codebook track, where $P_t$ is the number of non-zero pulses allowed in track t. The signs of the pulses are set to the sign of A(n) at the pulse location. These initial values 1466 for pulse locations and signs are then used to form an estimate of the fixed codebook gain, $g_{est}$, by the FCB gain estimation module 1430. The fixed codebook gain estimate 1468, the modified target signal 1464, and an impulse response signal 1470 are then used in the fast pulse position searching module 1440, which determines the final pulse locations and signs 1472. The impulse signal 1470 may be the same as or different from the impulse signal 1462. Finally, a signal 1474 for fixed codeword vector and indices of the fixed codebook is constructed by the codevector construction module 1450. The signal 1474 is output to the bitstream.

Figure 15:
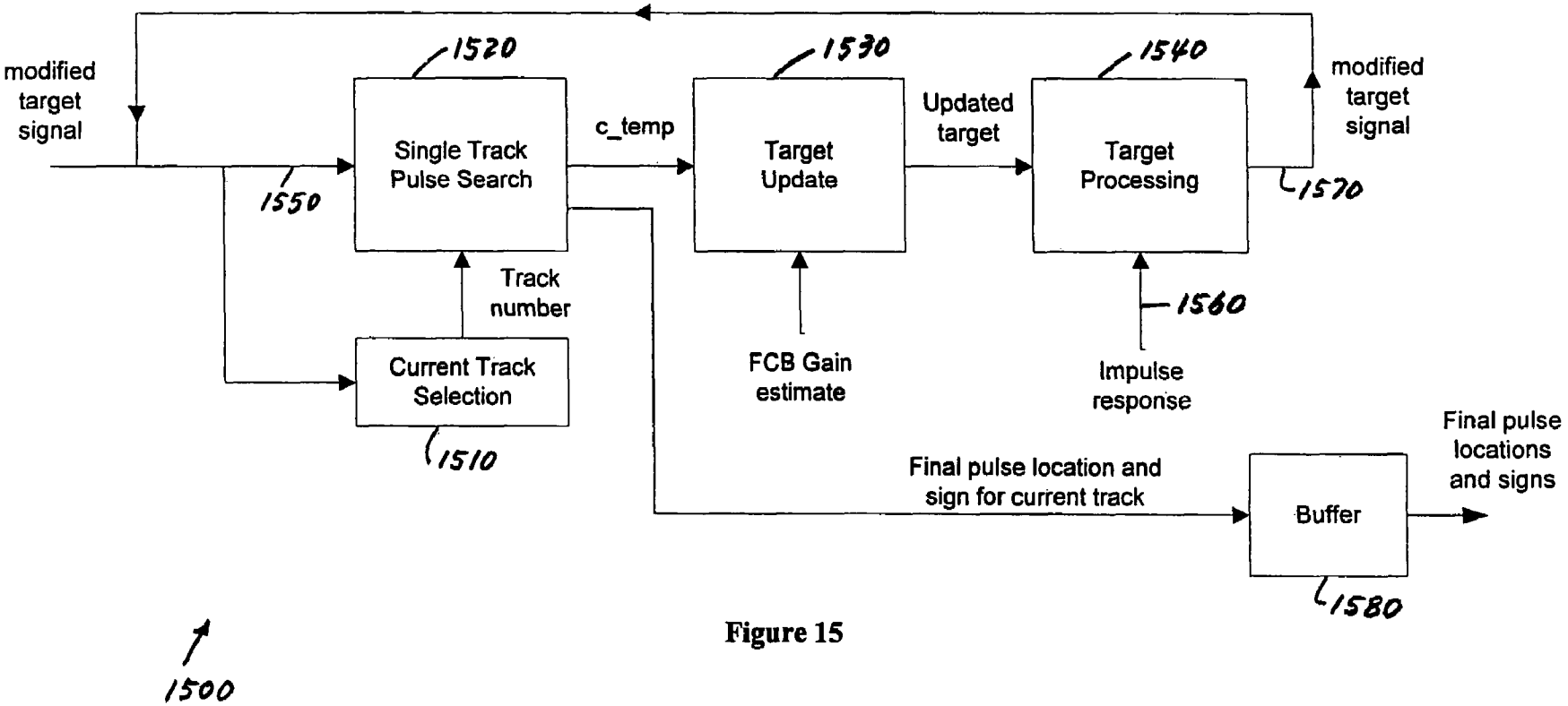
FIG. 15 is a simplified diagram for a fast pulse position searching module according to one embodiment of the present invention.

FIG. 15 is a simplified diagram for a fast pulse position searching module according to one embodiment of the present invention. This diagram is merely an example, which should not unduly limit the scope of the present invention. One of ordinary skill in the art would recognize many variations, alternatives, and modifications. A fast pulse position searching module 1500 includes a track selection module 1510, a single track pulse search module 1520, a target update module 1530, a target processing module 1540, and a buffer module 1580. For example, the fast pulse position searching module 1500 is used as the fast pulse position searching module 1440. Although the above has been shown using various modules, there can be many alternatives, modifications, and variations. For example, some of the modules may be expanded and/or combined. Other modules may be inserted to those noted above. Depending upon the embodiment, the specific modules may be replaced. Further details of these modules are found throughout the present specification.

The track selection module 1510 is optional, and can be tuned so that pulses or tracks are searched in a particular order. For example, it may be desirable to set pulses in tracks with the highest amplitude sample or highest energy first. The single track pulse search module 1520 takes as input a modified target signal 1550, A(n) and the track number, t, which defines the candidate pulse positions in the subframe and locates the position of the $P_t$ largest samples. The target update module 1530 determines the speech domain contribution of the $P_t$ pulses of the current track by convolving them with an impulse response signal 1560, h(n), and adjusting the gain using $g_{est}$. Since in ACELP, the pulses are simple impulses of amplitude +1 or −1, their speech domain contribution is simply the sum of the $P_t$ impulses, located at the chosen positions and gain-adjusted. This contribution is subtracted from the fixed codebook target signal 1460, $x_2(n)$. The target processing module 1540 generates another modified target signal 1570 by correlating the result with the impulse response signal 1560. The modified target signal 1570 may be used as an input to the track selection module 1510 and the signal track pulse search module 1520 as the modified target signal 1550 for further processing. The buffer module stores the positions and signs of the tracks which have been searched, and outputs the positions and signs of all pulses in the subframe once all tracks have been searched.

Depending on the voice coding standard, the effect of forward and or backward pulse enhancements may be included.

$$x_2(n) \leftarrow x_2(n) - g_{est} \cdot sign(k) \sum_{k=0}^{P_t} h(n - p(k)),\ n = 0,\ \ldots,\ l_{sf}, \quad \text{(Equation 15)}$$

$$A(n) \leftarrow \sum x_2(j) \cdot h(j+n),\ n = 0,\ \ldots,\ l_{sf}, \quad \text{(Equation 16)}$$

Since the search algorithm of an embodiment of the present invention searches $P_t$ pulses at once in a single track, a modified constraint for multiple pulses in the same location may be applied if the codec standard permits. The algorithm may also be modified to only select one pulse position in each iteration, rather than all pulses in the track.

Figure 16:
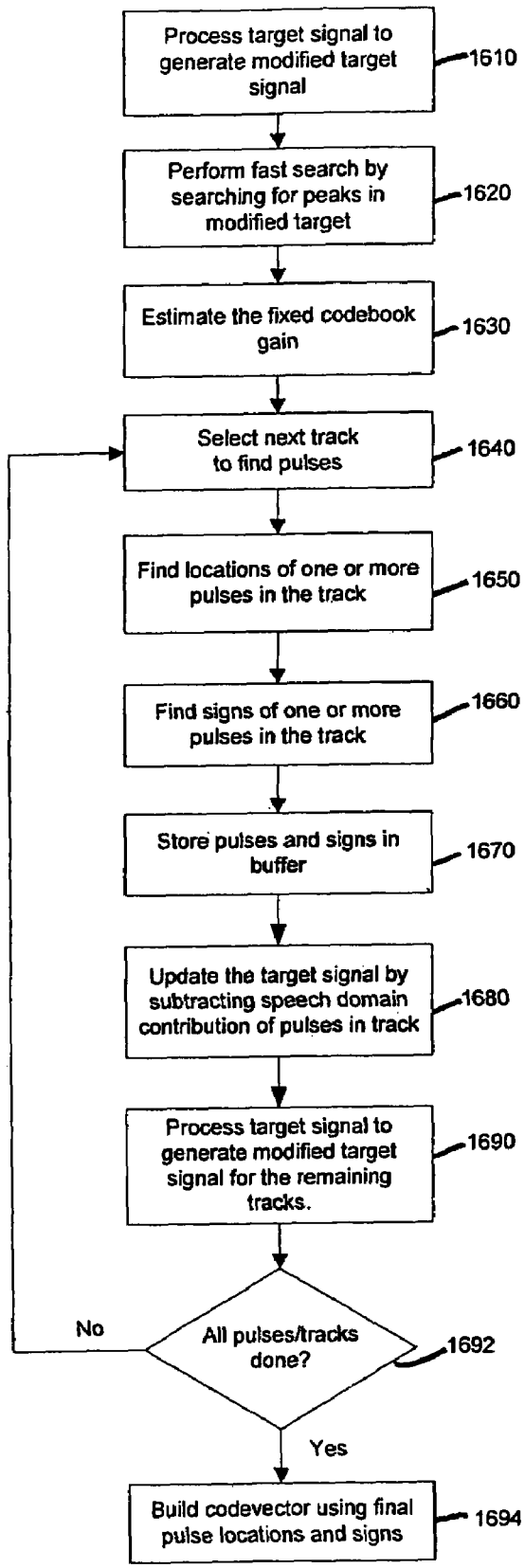
FIG. 16 is a simplified diagram for fast pulse position searching according to one embodiment of the present invention.

FIG. 16 is a simplified diagram for fast pulse position searching according to one embodiment of the present invention. This diagram is merely an example, which should not unduly limit the scope of the present invention. One of ordinary skill in the art would recognize many variations, alternatives, and modifications. A method 1600 for fast pulse position searching includes a process 1610 for generating modified target signal, a process 1620 for performing fast search by searching for peaks in modified target; a process 1630 for estimating fixed codebook gain, a process 1640 for selecting next track to find pulses; a process 1650 for finding locations of one or more pulses in track, a process 1660 for finding signs of one or more pulses in track, a process 1670 for storing pulse locations and signs in a buffer, a process 1680 for updating the target signal by subtracting the contribution of pulses in the current track, a process 1690 for creating modified target signal for remaining tracks, a process 1692 for determining whether all pulses or tracks have been processed, and a process 1694 for building codevector. In one example, the method 1600 for fast pulse position searching is implemented by the fast fixed codebook mapping module 1400. Although the above has been shown using a selected sequence of processes, there can be many alternatives, modifications, and variations. For example, some of the processes may be expanded and/or combined. Other processes may be inserted to those noted above. Depending upon the embodiment, the specific sequence of steps may be interchanged with others replaced. Further details of these processes are found throughout the present specification.

As an example, the fast pulse position search method 1600 is applied to the 12.2 kbps mode of GSM-AMR in a G.723.1 to GSM-AMR transcoder. Using the search procedure according to one embodiment of the present invention, only five correlations and four convolutions are required per subframe to determine the pulse positions and signs for the 10-pulse codevector. The five correlations correspond to one correlation per track, and the four convolutions correspond to one convolution per track except for the last track. The convolution is simplified as one signal in the convolution has only two non-zero samples. The signal is a vector containing only the pulses in the current track, $c_{temp}(n)$. However, the correlation is between two non-sparse vectors of subframe length $l_{sf}$=40. This usually requires considerable multiplication/addition operations. By taking advantage of previously calculated values and the ability to change the order of operations, the algorithm implementation can be simplified. Instead of performing the calculations in Equations 14 through 16, the following shortcut can be used. The difference b(n) between A(n) and the updated A(n) is the correlation of the filtered, gain adjusted $c_{temp}(n)$ with h(n).

$$\text{First, } b(n)=g_{est}\cdot\Sigma c_{temp'filt}(j)\cdot h(j+n),\ n=0,\ \ldots,\ l_{sf}, \quad \text{(Equation 17)}$$

$$\text{where } c_{temp'filt}(n)=\Sigma c_{temp}(j)\cdot h(n-j),\ n=0,\ \ldots,\ l_{sf}, \quad \text{(Equation 18)}$$

Hence, computations can be reduced by subtracting b(n) from A(n) as follows:

$$A(n)\leftarrow A(n)-b(n),\ n=0,\ \ldots,\ l_{sf}, \quad \text{(Equation 19)}$$

To further reduce computational complexity, Equation 17 can be rearranged to $$b(n)=g_{est}\cdot\Sigma c_{temp}(j)\cdot \text{autocorrh}(n-j),\ n=0,\ \ldots,\ l_{sf}, \quad \text{(Equation 20)}$$

$$\text{where autocorrh}(n)=\Sigma h(j)\cdot h(j+n),\ n=0,\ \ldots,\ l_{sf}, \quad \text{(Equation 21)}$$

The autocorrelation of h(n), autocorrh(n), can be precomputed at the beginning of every subframe. Thus, b(n) can be efficiently calculated requiring only a convolution between a pre-computed vector and $c_{temp}(n)$, which has only 2 non-zero pulses. This reduces the computations to only one autocorrelation, one cross-correlation, and four "convolutions" with a sparse vector, $c_{temp}(n)$ per subframe.

In a specific embodiment, the two pulses in the track can be located in the same position if certain criteria are met. The criteria may take a number of forms, for example, if the amplitude of the highest pulse in the track is more than 0.9 times the maximum target amplitude considering all tracks in the subframe and more than 10 times the amplitude of the other pulse.

The fast fixed codebook search method according to certain embodiments of the present invention may be applied to CELP coders with algebraic codebooks, or those with sparse multi-pulse coders that can be adapted to have an algebraic-like structure. The method can achieve reduced complexity compared to other search methods, without requiring numerous combinations of pulse positions to be tested.

The CELP parameter mapping according to certain embodiments of the present invention may be applied to at least CELP-based voice codecs, and voice transcoders between the existing codecs G.723.1, GSM-AMR, EVRC, G.728, G.729, G.729A, QCELP, MPEG-4 CELP, SMV, AMR-WB, and VMR. In some embodiments of the present invention, the fast fixed codebook mapping module can be adapted to suit an algebraic or multi-pulse fixed codebook with any track orientation, number of pulses, and subframe size. In certain embodiments of the present invention, the fast fixed codebook mapping module is applicable in any transcoder framework where the destination codec uses a sparse fixed codebook. In some embodiments of the present invention, the fast adaptive codebook mapping module is applicable in any transcoder framework where the destination codec uses a multi-tap pitch filter. In certain embodiments of the present invention, the LSP parameter mapping module, the fast fixed codebook mapping module, and the fast adaptive codebook mapping module operate independently of each other.

Numerous benefits are achieved using the present invention over other techniques. Certain embodiments of the present invention provides an apparatus and method for fast LSP mapping, fast adaptive codebook mapping, and fast fixed codebook mapping. The apparatus and method can adjust mapped linear prediction parameters to prevent signal overflow in the decoder of a destination codec. Some embodiments of the present invention can reduce the amount of computation and the complexity of computational complexity. For example, computations for testing candidate codevectors is reduced, or computations for generating entries for the pitch gain codebook is reduced. In certain embodiments of the present invention, the amount of memory needed is also reduced. For example, the simplified pitch gain codebook contains fewer elements in each codevector entry. In some embodiments of the present invention, the auto-correlation and cross-correlation computation unit outputs a reduced length vector of dot-product elements in a format that matches the terms in the entries of the simplified pitch gain codebook. In certain embodiments, the complexity of the adaptive codebook search of the present invention is lower than the complexity of other adaptive codebook searches due to the simplification of the pitch gain codebook, the reduction in the number of computed correlation dot products, the reduction in the number of computed residual signals and the reduction in the number of computed delayed weighted synthesis signals.

Although specific embodiments of the present invention have been described, it will be understood by those of skill in the art that there are other embodiments that are equivalent to the described embodiments. Accordingly, it is to be understood that the invention is not to be limited by the specific illustrated embodiments, but only by the scope of the appended claims.

What is claimed is:

1. An apparatus for mapping CELP parameters between a source codec and a destination codec, the apparatus comprising:

an LSP mapping module;

an adaptive codebook mapping module coupled to the LSP mapping module;

a fixed codebook mapping module coupled to the LSP mapping module and the adaptive codebook mapping module;

wherein the LSP mapping module comprises:

an LP overflow module configured to process information associated with a plurality of interpolated LSP parameters and generate an overflow signal based on at least information associated with the plurality of interpolated LSP parameters;

an LSP parameter modification module configured to modify at least one frequency of at least one of the plurality of interpolated LSP parameters in response to the overflow signal;

wherein the adaptive codebook mapping module comprises a first pitch gain codebook, the first pitch gain codebook including a first plurality of entries, each of the first plurality of entries including a plurality of terms and a plurality of sums associated with the plurality of terms;

wherein the fixed codebook mapping module comprises:

a first target processing module configured to process a first target signal and generate a first modified target signal;

a pulse search module configured to locate a first plurality of pulse positions and signs for a plurality of pulses in a subframe based on at least information associated with the first modified target signal;

a fixed codebook gain estimation module configured to estimate a fixed codebook gain for the subframe based on at least information associated with the first plurality of pulse positions and signs;

a pulse position searching module configured to receive the first modified target signal, an impulse response signal and the estimated fixed codebook gain and to output a second plurality of pulse positions and signs for the plurality of pulses.

2. The apparatus of claim 1 wherein the LSP parameter modification module is further configured to increase or decrease the at least one frequency of the at least one of the plurality of interpolated LSP parameters in response to the overflow signal.

3. The apparatus of claim 2 wherein the LSP parameter modification module is substantially free from a degradation of a signal quality.

4. The apparatus of claim 2 wherein a decoder of the destination codec is free from a signal overflow.

5. The apparatus of claim 1 wherein the plurality of terms are associated with at least one element related to a first gain coefficient for a first tap of a pitch filter, and the plurality of sums are associated with a plurality of products, the plurality of products associated with at least a second gain coefficient for a second tap of the pitch filter and a third gain coefficient for a third tap of the pitch filter.

6. The apparatus of claim 5 wherein the second tap of the pitch filter is the same as the third tap of the pitch filter.

7. The apparatus of claim 1 wherein the adaptive codebook mapping module is associated with a destination codec including a multi-tap pitch filter.

8. The apparatus of claim 1 wherein the pulse position searching module comprises:

a single track pulse search module configured to locate at least one position and one sign of at least one pulse in a first track;

a target update module configured to remove a contribution of the at least one pulse from the first target signal and output a first updated target signal;

a second target processing module configured to receive the first updated target signal and output a second modified target signal;

a buffer module configured to store the at least one position and one sign of the at least one pulse in the first track and output the second plurality of pulse positions and signs for the plurality of pulses.

9. The apparatus of claim 8 wherein the pulse position searching module further comprises a track selection module configured to select the first track.

10. The apparatus of claim 1 wherein the fixed codebook mapping module is associated with a fixed codebook, the fixed codebook being an algebraic fixed codebook or a multi-pulse fixed codebook.

11. The apparatus of claim 1 wherein the fixed codebook mapping module is associated with a destination codec including a sparse fixed codebook.

12. The apparatus of claim 1 wherein the LSP mapping module further comprises:

an LSP quantization module configured to quantize the plurality of interpolated LSP parameters based on at least information associated with a plurality of quantization tables related to a destination codec;

an LSP decoder and stability check module configured to decode the quantized plurality of interpolated LSP parameters.

13. The apparatus of claim 12 wherein the LSP decoder and stability check module is further configured to process information associated with ordering and spacing between a first parameter and a second parameter of the decoded plurality of interpolated LSP parameters, the first parameter and the second parameter being adjacent to each other.

14. The apparatus of claim 1 wherein the adaptive codebook mapping module further comprises:

an adaptive codebook target generation module configured to generate a second target signal;

an adaptive codebook configured to store a plurality of excitation signals;

a candidate lag selection module configured to receive an open-loop pitch lag and generate a candidate pitch lag value;

a candidate vector signal generation module configured to generate a plurality of candidate signals based on at least information associated with the adaptive codebook and the candidate pitch lag value;

an auto-correlation and cross-correlation module configured to calculate a set of dot products of the second target signal and delayed versions of the plurality of candidate signals or of the delayed versions of the plurality of candidate signals, and to output a vector signal associated with at least the set of dot products;

a gain codevector selection module configured to receive the vector signal, to estimate a dot product of an entry associated with the first pitch gain codebook and the received vector signal, processing at least information associated with the dot product and a predetermined value, and output an index of a selected codevector and an adaptive codebook pitch lag associated with the selected codevector;

a buffer module to store the index of the selected codevector and the adaptive codebook pitch lag.

15. The apparatus of claim 14 wherein the predetermined value is a predetermined maximum value.

16. The apparatus of claim 14 wherein the first plurality of entries are correlated to a second plurality of entries of a second pitch gain codebook of a destination codec.

17. The apparatus of claim 14, wherein the vector signal is associated with the plurality of terms and the plurality of sums.

18. The apparatus of claim 1 wherein the fixed codebook mapping module comprises:

a fixed codebook target generation module configured to generate the first target signal;

a codevector construction module configured to receive the second plurality of pulse positions and signs, to generate a fixed codebook vector based on at least information associated with the second plurality of pulse positions and signs, and to determine fixed codebook indices for the subframe based on at least information associated with the second plurality of pulse positions and signs.

19. The apparatus of claim 1 wherein the LSP mapping module, the adaptive codebook mapping module, and the fixed codebook mapping module are configured to operate independently of each other.

20. An apparatus for mapping LSP parameters between a source codec and a destination codec, the apparatus comprising:

an LP overflow module configured to process information associated with a plurality of interpolated LSP parameters and generate an overflow signal based on at least information associated with the plurality of interpolated LSP parameters;

an LSP parameter modification module configured to modify at least one frequency of at least one of the plurality of interpolated LSP parameters in response to the overflow signal;

an LSP quantization module configured to quantize the plurality of interpolated LSP parameters based on at least information associated with a plurality of quantization tables related to a destination codec;

an LSP decoder and stability check module configured to decode the quantized plurality of interpolated LSP parameters.

21. An apparatus for mapping adaptive codebooks between a source codec and a destination codec, the apparatus comprising:

an adaptive codebook target generation module configured to generate a target signal; a pitch gain codebook, the pitch gain codebook including a plurality of entries, each of the plurality of entries including a plurality of terms and a plurality of sums associated with the plurality of terms;

a candidate lag selection module configured to receive an open-loop pitch lag and generate a candidate pitch lag value;

a candidate vector signal generation module configured to generate a plurality of candidate signals based on at least information associated with the adaptive codebook and the candidate pitch lag value;

an auto-correlation and cross-correlation module configured to calculate a set of dot products of the target signal and delayed versions of the plurality of candidate signals or of the delayed versions of the plurality of candidate signals, and to output a vector signal associated with at least the set of dot products;

a gain codevector selection module configured to receive the vector signal, to compute a dot product of an entry associated with the pitch gain codebook and the received vector signal, processing at least information associated with the dot product and a predetermined value, and output an index of a selected codevector and an adaptive codebook pitch lag associated with the selected codevector;

a buffer module to store the index of the selected codevector and the adaptive codebook pitch lag.

22. An apparatus for mapping fixed codebooks between a source codec and a destination codec, the apparatus comprising:

a fixed codebook target generation module configured to generate a first target signal;

a target processing module configured to process the first target signal and generate a first modified target signal;

a pulse search module configured to locate a first plurality of pulse positions and signs for a plurality of pulses in a subframe based on at least information associated with the first modified target signal;

a fixed codebook gain estimation module configured to estimate a fixed codebook gain for the subframe based on at least information associated with the first plurality of pulse positions and signs;

a pulse position searching module configured to receive the first modified target signal, an impulse response signal and the estimated fixed codebook gain and to output a second plurality of pulse positions and signs for the plurality of pulses;

a codevector construction module configured to receive the second plurality of pulse positions and signs, to generate a fixed codebook vector, and to determine a set of fixed codebook indices for the subframe.

23. The apparatus of claim 22 wherein the pulse position searching module comprises:

a single track pulse search module configured to locate at least one position and one sign of at least one pulse in a first track;

a target update module configured to remove a contribution of the at least one pulse from the first target signal and output a first updated target signal;

a second target processing module configured to receive the first updated target signal and output a second modified target signal;

a buffer module configured to store the at least one position and one sign of the at least one pulse in the first track and output a second plurality of pulse positions and signs for a plurality of pulses.

24. A method for CELP parameter mapping comprising the steps of:

unpacking a CELP parameter bitstream into at least a set of first quantized LSP values, a set of first quantized adaptive codebook values and a set of first quantized fixed codebook values;

mapping the set of first quantized LSP values to a set of second quantized LSP values;

mapping the set of first quantized adaptive codebook values to a set of second quantized adaptive codebook values;

mapping the set of first quantized fixed codebook values to a set of second quantized fixed codebook values; and organizing at least the set of second quantized LSP values, the set of second quantized adaptive codebook values and the set of second quantized fixed codebook values in an outgoing bitstream.

25. A method of mapping a first set of quantized CELP LSP parameters to a second set of quantized LSP parameters comprising the steps of:

selecting a set of one or more LSP values from a target codebook of one or more LSP values based on at least one other LSP value selected from a source codebook;

determining a stability value for a filter represented by the set of LSP values and a measure of difference between the target codebook and the source codebook; and modifying the selected set of one or more LSP values based on the stability value.

26. The method of claim 25 wherein determining the stability value comprises calculating a spread measure of the set of one or more LSP values.

27. The method of claim 25 wherein selecting a set of one or more LSP values from a target codebook comprises:

calculating a set of difference values between each LSP value and each value in the target codebook;

determining a least difference value from the set of difference values;

setting the value in the target codebook corresponding to the least difference value as a selected LSP value.

28. The method of claim 25 wherein selecting a set of one or more LSP values from a target codebook comprises using a vector quantization method.

29. A method for mapping a first quantized set of CELP adaptive codebook parameters to a second quantized set of CELP adaptive codebook parameters comprising the steps of:

determining a set of expected correlation values between a target vector and a set of codebook vectors associated with a lag value;

selecting a subset of codebook vectors from the set of codebook vectors based on the set of expected correlation values;

calculating a correlation value between the target vector and each vector in the subset of codebook vectors;

selecting a codebook vector associated with the correlation value above a predetermined threshold;

calculating a gain value based on the difference between the target vector and the selected codebook vector; and setting at least the lag associated with the selected codebook vector and the gain value as destination adaptive codebook parameters.

30. The method of claim 29 wherein determining a set of expected correlation values between a target vector and a set of codebook vectors associated with a lag value comprises determining correlation values between the target vector and a time shifted version of the target vector.

31. A method for mapping a first set of quantized CELP fixed codebook parameters from a second set of quantized CELP fixed codebook parameters comprising the steps of:

determining a target vector;

setting a threshold value;

selecting a vector of pulses from a codebook of pulses;

calculating an output response of a synthesis filter when the selected vector of pulses is used as input to the synthesis filter;

calculating a difference value between the calculated output response and the target vector;

setting the selected vector of pulses as a destination vector of pulses if the difference value is below the set threshold;

calculating a gain value between the destination vector and the target vector; and setting at least the gain value and the destination vector as the second set of quantized CELP fixed codebook parameters.

32. The method of claim 31 wherein selecting a vector of pulses from a codebook of pulses comprises:

selecting a pulse position from the codebook of pulses;

inserting a pulse at the selected pulse position in the vector of pulses; and removing all pulses from the vector of pulses if a number of pulses in the vector of pulses exceeds a predetermined maximum number of allowable pulses.

33. The method of claim 31 wherein the difference value is associated with a correlation value.

34. The method of claim 31 wherein setting a threshold value comprises:

calculating a set of autocorrelation values of the target vector;

determining a set of one or more positions corresponding to a set of maximum autocorrelation values;

calculating an expected difference value between the target vector and a vector containing a maximum number of pulses located at positions from the determined set of positions; and multiplying the expected difference value with a weighting factor.

* * * * *